US010594020B2

(12) United States Patent
Min et al.

(10) Patent No.: US 10,594,020 B2
(45) Date of Patent: Mar. 17, 2020

(54) ELECTRONIC DEVICE HAVING ANTENNA ELEMENT AND METHOD FOR MANUFACTURING THE SAME

(71) Applicant: Samsung Electronics Co., Ltd., Suwon-si, Gyeonggi-do (KR)

(72) Inventors: Young-hoon Min, Yongin-si (KR); Keon Kuk, Yongin-si (KR); In-hak Na, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/020,386

(22) Filed: Jun. 27, 2018

(65) Prior Publication Data

US 2019/0027805 A1 Jan. 24, 2019

Related U.S. Application Data

(60) Provisional application No. 62/534,327, filed on Jul. 19, 2017.

(30) Foreign Application Priority Data

Mar. 20, 2018 (KR) ..... 10-2018-0032050

(51) Int. Cl.
*H01Q 1/38* (2006.01)
*H01Q 1/22* (2006.01)
(Continued)

(52) U.S. Cl.
CPC ..... *H01Q 1/2283* (2013.01); *H01Q 1/2291* (2013.01); *H01Q 1/243* (2013.01);
(Continued)

(58) Field of Classification Search
CPC ..... H01Q 1/242; H01Q 13/10; H01Q 13/02; H01Q 21/00; H01Q 9/065; H01Q 9/28
(Continued)

(56) References Cited

U.S. PATENT DOCUMENTS 5,436,203 A 7/1995 Lin
5,641,438 A 6/1997 Bunyan et al.
(Continued)

FOREIGN PATENT DOCUMENTS

CN 101785097 A 7/2010
EP 2 187 435 A1 5/2010
(Continued)

OTHER PUBLICATIONS

Kim et al.; Onset condition of pulsating cone-jet mode of electrohydrodynamic jetting for plane, hole, and pin type electrodes; Journal of Applied Physics; Introducing Invited Perspectives; Ultrafast magnetism and THz spitronics; Nov. 24, 2010; vol. 108; American Institute of Physics; Seoul, KR.
(Continued)

*Primary Examiner* — Joseph J Lauture
(74) *Attorney, Agent, or Firm* — Jefferson IP Law, LLP

(57) ABSTRACT

An electronic device having an antenna element is provided. The electronic device includes a printed circuit board on which a plurality of components are mounted, at least one antenna element mounted on the printed circuit board, an insulating dam formed on the printed circuit board and configured to surround the at least one antenna element, and a dielectric part configured to fill an inside of the insulating dam and to support the at least one antenna element.

20 Claims, 20 Drawing Sheets

(51) Int. Cl.

| | |
|---|---|
| ***H01Q 1/24*** | (2006.01) |
| ***H01Q 21/08*** | (2006.01) |
| ***H01Q 9/04*** | (2006.01) |
| ***H01Q 23/00*** | (2006.01) |
| *H01Q 3/40* | (2006.01) |
| *H01Q 13/02* | (2006.01) |
| *H01Q 21/00* | (2006.01) |
| *H01Q 13/10* | (2006.01) |
| *H01Q 9/06* | (2006.01) |
| *H01Q 9/28* | (2006.01) |

(52) U.S. Cl.
CPC ..... *H01Q 1/38* (2013.01); *H01Q 9/0421* (2013.01); *H01Q 21/08* (2013.01); *H01Q 23/00* (2013.01); *H01Q 1/242* (2013.01); *H01Q 3/40* (2013.01); *H01Q 9/065* (2013.01); *H01Q 9/28* (2013.01); *H01Q 13/02* (2013.01); *H01Q 13/10* (2013.01); *H01Q 21/00* (2013.01)

(58) Field of Classification Search
USPC ..... 343/700, 702, 772, 793, 770, 725, 795
See application file for complete search history.

(56) References Cited

U.S. PATENT DOCUMENTS

| | | | |
|---|---|---|---|
| 5,650,659 | A | 7/1997 | Mostafazadeh et al. |
| 5,761,053 | A | 6/1998 | King et al. |
| 6,092,281 | A | 7/2000 | Glenn |
| 6,150,193 | A | 11/2000 | Glenn |
| 6,263,564 | B1 | 7/2001 | Holmberg et al. |
| 6,297,551 | B1 | 10/2001 | Dudderar et al. |
| 6,466,174 | B2 | 10/2002 | Haussler et al. |
| 6,601,293 | B1 | 8/2003 | Glenn |
| 6,933,894 | B2 | 8/2005 | Ghosh et al. |
| 6,962,829 | B2 | 11/2005 | Glenn et al. |
| 7,015,869 | B2 | 3/2006 | Marlow et al. |
| 7,141,869 | B2 | 11/2006 | Kim et al. |
| 7,196,275 | B2 | 3/2007 | Babb et al. |
| 7,311,937 | B2 | 12/2007 | Hashimoto |
| 7,482,686 | B2 | 1/2009 | Zhao et al. |
| 7,633,015 | B2 | 12/2009 | Wurzel et al. |
| 7,752,751 | B2 | 7/2010 | Kapusta et al. |
| 7,981,730 | B2 | 7/2011 | Tang et al. |
| 8,071,893 | B2 | 12/2011 | Lin et al. |
| 8,276,268 | B2 | 10/2012 | Kapusta et al. |
| 8,314,485 | B2 | 11/2012 | Ono et al. |
| 8,633,403 | B2 | 1/2014 | Lin et al. |
| 8,881,387 | B2 | 11/2014 | Lin et al. |
| 8,971,553 | B2 | 3/2015 | Takaoka |
| 9,192,057 | B2 | 11/2015 | Malek et al. |
| 9,572,264 | B2 | 2/2017 | Yamamoto et al. |
| 9,640,858 | B1 * | 5/2017 | Islam ..... H01Q 1/273 |
| 9,768,154 | B2 | 9/2017 | Tomonari et al. |
| 2001/0033478 | A1 | 10/2001 | Ortiz et al. |
| 2004/0087043 | A1 | 5/2004 | Lee et al. |
| 2004/0231872 | A1 | 11/2004 | Arnold et al. |
| 2005/0045358 | A1 | 3/2005 | Arnold |
| 2005/0280139 | A1 | 12/2005 | Zhao et al. |
| 2007/0030661 | A1 | 2/2007 | Morris et al. |
| 2007/0176281 | A1 | 8/2007 | Kim et al. |
| 2007/0187136 | A1 | 8/2007 | Higashiguchi et al. |
| 2007/0230131 | A1 | 10/2007 | Bunyan et al. |
| 2008/0044744 | A1 | 2/2008 | Yamazaki et al. |
| 2008/0292846 | A1 | 11/2008 | Muranaga |
| 2009/0244876 | A1 | 10/2009 | Li et al. |
| 2009/0244878 | A1 | 10/2009 | Wurzel et al. |
| 2010/0045181 | A1 | 2/2010 | Oh et al. |
| 2010/0188292 | A1 | 7/2010 | Rutfors |
| 2010/0200983 | A1 | 8/2010 | Ono et al. |
| 2010/0230789 | A1 | 9/2010 | Yorita et al. |
| 2010/0327431 | A1 | 12/2010 | Touzelbaev et al. |
| 2011/0006106 | A1 | 1/2011 | Kanryo et al. |
| 2012/0023743 | A1 | 2/2012 | Lin et al. |
| 2012/0104571 | A1 | 5/2012 | Yoo |
| 2012/0218727 | A1 | 8/2012 | Kim |
| 2012/0320558 | A1 | 12/2012 | Foster et al. |
| 2013/0083501 | A1 | 4/2013 | Azzopardi et al. |
| 2013/0114228 | A1 | 5/2013 | Merz et al. |
| 2013/0241039 | A1 | 9/2013 | Choi et al. |
| 2013/0286609 | A1 | 10/2013 | Merz |
| 2014/0002310 | A1 | 1/2014 | Kim et al. |
| 2014/0071634 | A1 | 3/2014 | Pakula et al. |
| 2014/0126157 | A1 | 5/2014 | Sawatari et al. |
| 2014/0160699 | A1 | 6/2014 | Zhang et al. |
| 2014/0198459 | A1 | 7/2014 | Cheng |
| 2014/0271961 | A1 | 9/2014 | Khoshnevis |
| 2015/0016066 | A1 | 1/2015 | Shimamura et al. |
| 2015/0022978 | A1 | 1/2015 | Steuer et al. |
| 2015/0022986 | A1 | 1/2015 | Steuer et al. |
| 2015/0036297 | A1 | 2/2015 | Chen et al. |
| 2015/0043189 | A1 | 2/2015 | Kitazaki et al. |
| 2015/0070851 | A1 | 3/2015 | Kitazaki et al. |
| 2015/0214602 | A1 | 7/2015 | Hobson et al. |
| 2016/0066481 | A1 | 3/2016 | Malek et al. |
| 2016/0066482 | A1 | 3/2016 | Chi et al. |
| 2016/0091575 | A1 | 3/2016 | Yamada et al. |
| 2016/0157392 | A1 | 6/2016 | Happoya |
| 2016/0262292 | A1 | 9/2016 | Kuk et al. |
| 2017/0117615 | A1 | 4/2017 | Choon et al. |
| 2017/0251549 | A1 | 8/2017 | Lee et al. |
| 2017/0295679 | A1 | 10/2017 | Kim et al. |
| 2017/0325365 | A1 | 11/2017 | Kuk et al. |
| 2018/0116078 | A1 | 4/2018 | Mun et al. |

FOREIGN PATENT DOCUMENTS

| | | | |
|---|---|---|---|
| EP | 3 266 043 | A1 | 1/2018 |
| JP | 6-283883 | A | 10/1994 |
| JP | 2001-251088 | A | 9/2001 |
| JP | 2004-048762 | A | 2/2004 |
| JP | 2011-124598 | A | 6/2011 |
| JP | 2011-146779 | A | 7/2011 |
| JP | 2015-065343 | A | 4/2015 |
| JP | 2016-111026 | A | 6/2016 |
| KR | 10-0321429 | B1 | 3/2002 |
| KR | 10-2006-0083770 | A | 7/2006 |
| KR | 10-0618085 | B1 | 8/2006 |
| KR | 10-0742098 | B1 | 7/2007 |
| KR | 10-2010-0064008 | A | 6/2010 |
| KR | 10-2012-0127852 | A | 11/2012 |
| KR | 10-2014-0111739 | A | 9/2014 |
| KR | 10-2014-0132880 | A | 11/2014 |
| KR | 10-1579623 | B1 | 12/2015 |
| KR | 10-2016-0031572 | A | 3/2016 |
| KR | 10-2016-0044953 | A | 4/2016 |
| KR | 10-2016-0045336 | A | 4/2016 |
| KR | 10-2016-0108117 | A | 9/2016 |
| KR | 10-2017-0125690 | A | 11/2017 |
| KR | 10-2018-0087551 | A | 8/2018 |
| KR | 10-2018-0101831 | A | 9/2018 |
| WO | 2004/047510 | A2 | 6/2004 |
| WO | 2005/029937 | A1 | 3/2005 |
| WO | 2016/144039 | A1 | 9/2016 |
| WO | 2017-111956 | A1 | 6/2017 |
| WO | 2017/191888 | A1 | 11/2017 |

OTHER PUBLICATIONS

Baek et al.; 3D Printing Process for Mass Production of PCB Component; Best Paper Award 2015; Samsung; Seoul, KR.

U.S. Office Action dated Mar. 1, 2019, issued in the U.S. Appl. No. 16/124,836.

U.S. Office Action dated Apr. 10, 2019, issued in the U.S. Appl. No. 15/488,024.

Notice of Allowance dated Oct. 5, 2018 issued in U.S. Appl. No. 15/489,190.

Search Report and Written Opinion dated Oct. 22, 2018 issued in International Application No. PCT/KR2018/007746.

Notice of Allowance dated Oct. 30, 2018 issued in U.S. Appl. No. 15/386,823.

(56) References Cited

OTHER PUBLICATIONS

Non-Final Office Action dated Nov. 8, 2018 issued in U.S. Appl. No. 15/488,024.
Non-Final Office Action dated Nov. 29, 2018 issued in U.S. Appl. No. 15/061,233.
Search Report and Written Opinion dated Dec. 17, 2018 issued in International Application No. PCT/KR2018/010501.
Extended European Search Report dated Feb. 12, 2019, issued in the European Patent Application No. 17792791.0.
Chinese Office Action dated Jul. 22, 2019; Application #: 201680014167.0.
Chinese Office Action dated Jun. 27, 2019; Application #: 201780028105.X.
USPTO office action dated Aug. 9, 2019; U.S. Appl. No. 15/061,233.

* cited by examiner

ELECTRONIC DEVICE HAVING ANTENNA ELEMENT AND METHOD FOR MANUFACTURING THE SAME

CROSS-REFERENCE TO RELATED APPLICATION(S)

This application is based on and claims priority under 35 U.S.C. § 119(a) of a Korean patent application number 10-2018-0032050 filed on Mar. 20, 2018, in the Korean Intellectual Property Office, and is based on and claims priority under 35 U.S.C. § 119(e) of a U.S. provisional application Ser. No. 62/534,327, filed on Jul. 19, 2017, in the U.S. Patent and Trademark Office, the disclosure of which is incorporated by reference herein in its entirety.

BACKGROUND

Field

The disclosure relates to an electronic device having a compact antenna element and a method for manufacturing the same. More particularly, the present disclosure relates to an electronic device having an antenna element capable of providing a stable antenna performance, achieving an easy mount, and securing a structural stability, and a method for manufacturing the same.

Description of the Related Art

Recently, efforts have been made to develop a fifth generation (5G) or pre-5G communication system that is improved as compared with an existing fourth generation (4G) communication system.

Such a 5G communication system is considered to be implemented in a millimeter (mm)-wave frequency band (e.g., 60 to 70 GHz band), and since the location of an electronic device, which supports a mobile network to which 5G communication is applied or a wireless local area mobile network (e.g., wireless local area network (LAN)), is varied in accordance with user's movement or the like, a wide beam scanning range may be required in providing a stable communication channel.

In mounting a millimeter-wave antenna for adopting the 5G communication system on an electronic device, manufacturing cost, power efficiency, miniaturization easiness, and stable access may be considered.

For example, as the communication frequency band is heightened, a high-level noise element or propagation loss in a radio frequency integrated circuit (RFIC) is increased. Accordingly, in order to secure a stable access, antenna gains may be compulsorily heightened, and this may cause power efficiency to deteriorate. As another example, a wide beam-forming and beam scanning range may be required to secure the stable access, but since directivity becomes greater as the communication frequency band is heightened, the beam-forming and beam scanning range may become narrowed.

Further, in case of an antenna that operates in the millimeter-wave frequency band, it can be easily miniaturized, and thus a space occupied by the antenna in a miniaturized wireless communication device and/or an electronic device, such as a mobile communication terminal (smart phone), can be reduced to enable the overall size of the electronic device to be reduced. However, in applying such a subminiature antenna to the electronic device, high precision is required in an antenna assembling or manufacturing process due to the small size of the antenna, and thus the overall manufacturing process or manufacturing cost of the electronic device having the millimeter-wave frequency band becomes increased.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide an electronic device having an antenna element capable of providing a stable antenna performance, achieving an easy mount, and securing a structural stability, and a method for manufacturing the same.

Additional aspects will be set forth in part in the description which follows and, in part, will be apparent from the description, or may be learned by practice of the presented embodiments.

In accordance with an aspect of the disclosure, an electronic device is provided. The electronic device includes a printed circuit board on which a plurality of components are mounted, at least one antenna element mounted on the printed circuit board, an insulating dam formed on the printed circuit board and configured to surround the at least one antenna element, and a dielectric part configured to fill an inside of the insulating dam and to support the at least one antenna element.

The printed circuit board may include a feeding pad to which the at least one antenna element is connected and a ground pad to which the at least one antenna element is connected.

The at least one antenna element may include a radiation part configured to face the ground pad, a feeding part configured to be bent from the radiation part and connected to the feeding pad, and a ground part configured to connect the radiation part and the ground pad with each other.

The dielectric part may surround the feeding part and the ground part, and the radiation part may be deployed on the dielectric part.

The radiation part, the feeding part, and the ground part may be integrally formed through a press process of a metal sheet.

A plurality of antenna elements may be configured to constitute an array antenna.

The plurality of components and the at least one antenna element may be collectively mounted on the printed circuit board.

The insulating dam may be configured in the shape of a closed loop that surrounds the at least one antenna element.

The dielectric part may include at least one feeding hole connected from one surface of the dielectric part to the feeding pad through penetration of the dielectric part, at least one ground hole connected from the one surface of the dielectric part to the ground pad through penetration of the dielectric part, and at least one radiation groove formed on the one surface of the dielectric part and configured to connect the at least one feeding hole and the at least one ground hole with each other, wherein the radiation part, the feeding part, and the ground part are composed of a conductive material filling in the radiation groove, the feeding hole, and the ground hole, respectively.

According to an aspect of the disclosure, a method for manufacturing an electronic device is provided. The method includes collectively mounting a plurality of components and a plurality of antenna elements on a printed circuit board, forming an insulating dam surrounding the plurality of antenna element by discharging an insulating material having a specific viscosity onto the printed circuit board, and forming a dielectric part supporting the plurality of antenna elements by discharging a dielectric material having a specific viscosity to an inside of the insulating dam.

The printed circuit board may include a feeding pad to which the plurality of antenna elements are connected and a ground pad to which the plurality of antenna elements are connected, and each of the plurality of antenna elements may include a radiation part configured to face the ground pad, a feeding part configured to be bent from the radiation part and connected to the feeding pad, and a ground part configured to connect the radiation part and the ground pad with each other.

The forming the dielectric part may discharge the dielectric material with a height corresponding to a height of the feeding part or a height of the ground part.

The radiation part, the feeding part, and the ground part may be integrally formed through a press process of a metal sheet.

The mounting the plurality of antenna elements on the printed circuit board may include collectively mounting on the printed circuit board the plurality of components and a dummy plate including the plurality of antenna elements, a plurality of connection parts connected to the plurality of antenna elements, and a dummy part connected to the plurality of connection parts, and separating the plurality of antenna elements from the dummy part by cutting the plurality of connection parts.

According to an aspect of the disclosure, a method for manufacturing an electronic device includes forming an insulating dam surrounding a feeding pad and a ground pad of a printed circuit board by discharging an insulating material having a specific viscosity onto the printed circuit board, forming a dielectric part by discharging a dielectric material having a specific viscosity to an inside of the insulating dam, forming at least one feeding hole connected from one surface of the dielectric part to the feeding pad of the printed circuit board through penetration of the dielectric part and at least one ground hole connected from the one surface of the dielectric part to the ground pad of the printed circuit board through penetration of the dielectric part, forming at least one radiation groove connecting the at least one feeding hole and the at least one ground hole with each other on the one surface of the dielectric part, and forming at least one antenna element by discharging a conductive material into the at least one feeding hole, the at least one ground hole, and the at least one radiation groove.

Other aspects, advantages, and salient of the disclosure will become apparent to those skilled in the art from the following detailed description, which, taken in conjunction with the annexed drawings, disclosure various embodiments of the disclosure.

BRIEF DESCRIPTION OF THE DRAWINGS

The above and other aspects, features, and advantages or certain embodiments of the disclosure will be more apparent from the following description taken in conjunction with the accompanying drawings, in which.

DETAILED DESCRIPTION

Figure 1:
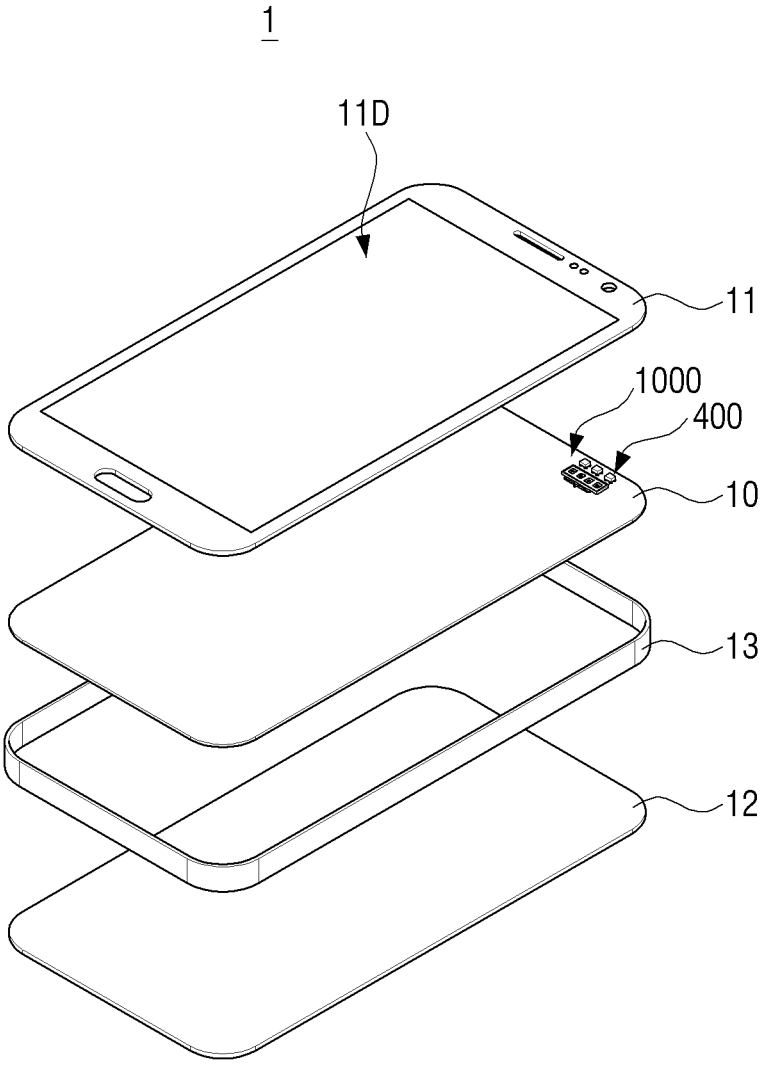
FIG. 1 is an exploded perspective view of an electronic device according to an embodiment of the disclosure.

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those or ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

By the term "substantially" it is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

If it is described that a certain constituent element is "on" or "in contact with" another constituent element, it should be understood that not only the certain constituent element is in direct contact with or is connected to the other constituent element but also a still another constituent element may exist between the above-described constituent elements. In contrast, if it is described that a certain constituent element is "directly on" or "in direct contact with" another constituent element, it may be understood that a still another constituent element does not exist between the above-described constituent elements. Other expressions explaining a relationship between constituent elements, for example, "~between" and "~directly between" may be analyzed in the same manner.

The terms "first, second, and so forth" may be used to describe various elements, but should not be limited to the corresponding terms. The above-described terms may be used only for the purpose of discriminating one constituent element from another constituent element. For example, without departing from the scope of the disclosure, the first element may be called the second element, and the second element may be called the first element in a similar manner.

In the description, a singular expression may include a plural expression unless clearly differently described on the context. The term "includes" or "has" used in the description represents that features, figures, operations, constituent elements, components, or combinations thereof exist, and thus the term should be understood that one or more other features, figures, operations, constituent elements, components, or combinations thereof may be added thereto.

Unless differently defined, the terms used in embodiments of the disclosure may be analyzed as meanings generally known to those of ordinary skill in the art to which the disclosure pertains.

FIG. 1 is an exploded perspective view of an electronic device according to an embodiment of the disclosure.

Referring to FIG. 1, an electronic device 1 according to the disclosure may be called a wireless communication device, a terminal, a portable terminal, a mobile terminal, a communication terminal, a portable communication terminal, a portable mobile terminal, or a display device.

For example, the electronic device 1 may be a smart phone, a portable phone, a navigation device, a game machine, a television (TV), a vehicle head unit, a notebook computer, a laptop computer, a tablet computer, a personal media player (PMP), or a personal digital assistants (PDA). The electronic device 1 may be implemented as a pocket-sized portable communication terminal having a wireless communication function. Further, the electronic device 1 may be a flexible device or a flexible display device.

The electronic device 1 may communicate with an external electronic device, such as a server, through an antenna part 1000, or may perform a job through a network with the external electronic device. Such a network, although not limited thereto, may be, for example, a mobile or cellular communication network, a local area network (LAN), a wireless local area network (WLAN), a wide area network (WAN), Internet, or a small area network (SAN).

The electronic device 1 may include a front cover 11, a back cover 12, a frame 13 connecting the front cover 11 and the back cover 12 with each other, and a printed circuit board 10 deployed on the inside of the frame 13.

The front cover 11 is roughly in a rectangular shape to configure the front part of the electronic device 1, and may include a display part 11D capable of displaying an image toward the front.

The back cover 12 configures the back part of the electronic device 1.

The frame 13 is configured in a closed loop shape, and configures side parts of the electronic device 1 through connection of the front cover 11 and the back cover 12 with each other.

The back cover 12 and the frame 13 may be integrally configured, or the front cover 11 and the frame 13 may be integrally configured.

The front cover 11, the back cover 12, and the frame 13 may configure an external appearance of the electronic device 1.

On the inside of the front cover 11, the back cover 12, and the frame 13, the printed circuit board 10 is deployed.

The antenna part 1000 and various components 400 are mounted on the printed circuit board 10.

Here, the various components 400 may be different kinds of circuit elements for driving the electronic device 1, and may also be an integrated circuit (IC) chip, passive elements, and release components. For example, the IC chip may be an application processor (AP), memory, or radio frequency (RF) chip, and the passive element may be a resistor, a capacitor, or a coil. The release components may be a connector, card socket, or electromagnetic wave shielding component.

Although FIG. 1 illustrates three components 400 deployed adjacent to the antenna part 1000, various numbers and kinds of components may be mounted on various locations of the printed circuit board 10.

As illustrated in FIG. 1, the antenna part 1000 may be mounted on an upper end part of the printed circuit board 10 to transmit/receive an electrical signal to/from an outside. However, the mount locations of the antenna part 1000 on the printed circuit board 10 may be variously changed.

Figure 2:
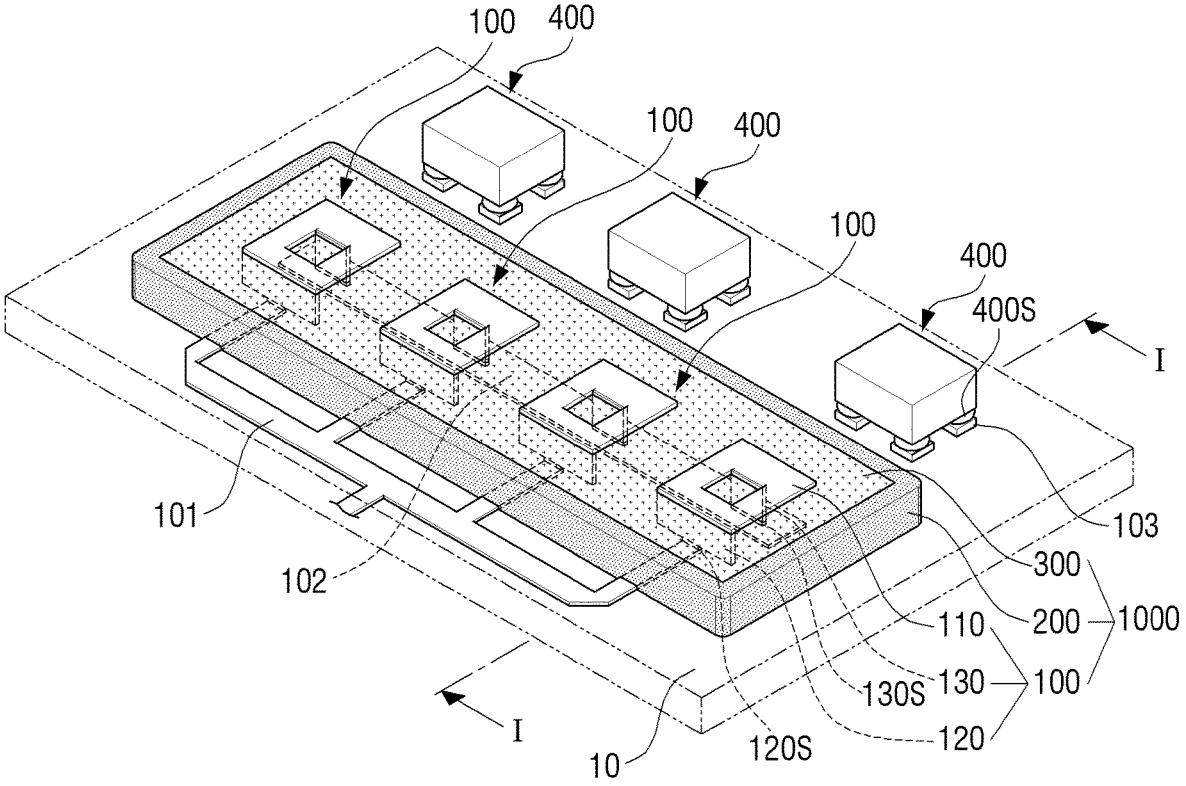
FIG. 2 is an enlarged perspective view of a part of a printed circuit board on which an antenna part as illustrated in FIG. 1 is deployed according to an embodiment of the disclosure.

The antenna part 1000 includes at least one antenna element 100 (see FIG. 2), an insulating dam 200 (see FIG. 2), and a dielectric part 300 (see FIG. 2).

The detailed structure of the antenna part 1000 will be described below.

In FIG. 1, a smart phone is illustrated as an example of the electronic device 1 according to an embodiment of the disclosure. However, as described above, the electronic device 1 may be implemented by various appliances, and since a general structure of the electronic device 1 is equal or similar to that in the related art, the duplicate explanation thereof will be omitted.

Figure 3:
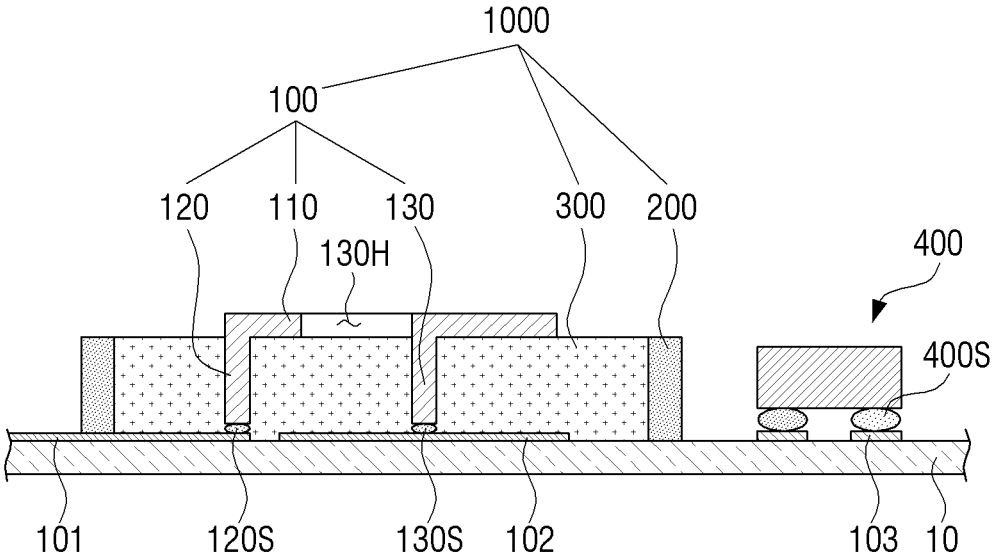
FIG. 3 is a cross-sectional view of a printed circuit board on which an antenna part is deployed taken along line I-I of FIG. 2 according to an embodiment of the disclosure.

FIG. 2 is an enlarged perspective view of a part of a printed circuit board on which an antenna part as illustrated in FIG. 1 is deployed according to an embodiment of the disclosure, and FIG. 3 is a cross-sectional view of a printed circuit board on which an antenna part is deployed taken along line I-I of FIG. 2 according to an embodiment of the disclosure.

Referring to FIGS. 2 and 3, the structure of at least one of the antenna element 100, the insulating dam 200, and the dielectric part 300, which constitute the antenna part 1000 of the electronic device 1 will be described.

At least one antenna element 100 is mounted on the printed circuit board 10 on which a plurality of components are mounted.

As illustrated in FIGS. 2 and 3, a plurality of antenna elements 100 may be mounted on the printed circuit board 10, and for example, four antenna elements 100 may be mounted.

Accordingly, the antenna part 1000 may include the plurality of antenna elements 100.

The at least one antenna element 100 may transmit/receive an electrical signal, and the plurality of antenna elements 100 may be arranged in a predetermined shape to constitute an array antenna. For example, as illustrated in FIG. 2, four antenna elements 100 may be arranged in a line to constitute an array antenna, and the plurality of antenna elements 100 may form a phase array antenna as they are provided with independent phase-difference feeds from each other.

Hereinafter, for convenience in explanation, it is exemplified that a plurality of antenna elements 100 are configured. However, even a single antenna element 100 may be configured, and the number and arrangement of the plurality of antenna elements 100 constituting an array antenna may be changed in various ways.

The printed circuit board 10 includes a feeding pad 101 to which the at least one antenna element 100 is connected and a ground pad 102 to which the at least one antenna element 100 is connected.

In addition, the printed circuit board 10 may further include a plurality of connection pads 103 to which a plurality of components 400 are connected.

The feeding pad 101 and the ground pad 102 are formed on one surface (upper surface) of the printed circuit board 10 on which the antenna element is mounted, and are deployed adjacent to each other.

Since the antenna element 100 is connected to the feeding pad 101 of the printed circuit board 10, the feeding pad 101 may feed power to the antenna element 100, and thus the antenna element 100 may radiate an electrical signal.

In addition, the antenna element 100 is connected to the ground pad 102 to be grounded, and through this, the antenna element 100 may operate as a monopole antenna.

More specifically, the at least one antenna element includes a radiation part 110 configured to face the ground pad 102, a feeding part 120 configured to be bent from the radiation part 110 and connected to the feeding pad 101, and a ground part 130 configured to connect the radiation part 110 and the ground pad 102 with each other.

As illustrated in FIGS. 2 and 3, the radiation part 110 may be configured in a roughly rectangular shape, and is deployed to face the ground pad 102. Further, the feeder part 120 is bent in a vertical direction from the radiation part 110, and one end of the feeding part 120 is connected to the feeding pad 101. In addition, the ground part 130 may ground the radiation part 110 in a manner that one end of the ground part 130 is connected to a lower surface of the radiation part 110 and the other end of the ground part 130 is connected to the ground pad 102.

The radiation part 110 may radiate an electrical signal since power is fed thereto through the feeding part 120, and the feeding part 120 may also radiate an electrical signal since power is fed thereto from the feeding pad 101.

The antenna element 100 may radiate the electrical signal in a direction that is vertical to the printed circuit board 10 (in an upward direction of FIG. 3) through the radiation part 110, and the antenna element 100 may also radiate the electrical signal even in a horizontal direction of the printed circuit board 10 (in a horizontal direction of FIG. 3) through the feeding part 120 deployed vertically to the radiation part 110. For example, the direction of the electrical signal radiating through the radiation part 110 may be vertical to the direction of the electrical signal radiating through the feeding part 120, and through this, the antenna element 100 can secure wide beamforming and beam scanning ranges.

The feeding pad 101 may have an upper surface exposed on the printed circuit board 10, and may be in a branched shape to be connected to respective feeding parts 120 of a plurality of antenna elements 100. In addition, a plurality of feeding pads may be configured to be connected to the plurality of antenna elements 100, and independently feed power to the plurality of antenna elements 100.

The ground pad 102 also has an upper surface exposed on the printed circuit board 10, and is deployed adjacent to the feeding pad 101. The ground pad 102 may be integrally formed on a ground layer (not illustrated) formed inside the printed circuit board 10.

The ground pad 102 may be configured to face the respective radiation parts 110 of the plurality of antenna elements 100, and may be configured in the shape of a plate corresponding to an arrangement of the plurality of radiation parts 110.

The feeding part 120 may be connected to the feeding pad 101 through a connection part 120S, and may be electrically connected to the feeding pad 101 through connection to the feeding pad 101 through the connection part 120S coupled to a lower end portion of the feeding part 120.

In addition, the ground part 130 may also be connected to the ground pad 102 through a connection part 130S, and may be electrically connected to the ground pad 102 through connection to the ground pad 102 through the connection part 130S coupled to a lower end portion of the ground part 130.

Further, the plurality of components 400 may also be connected to a plurality of connection pads 103 through separate connection parts 400S, and may be electrically connected to the plurality of connection pads 103 through connection to the plurality of connection pads 103 through the plurality of connection parts 400S coupled to respective lower end portions of the plurality of components 400.

The above-described connection parts 120S, 130S, and 400S may be composed of solder balls or solder cream, and the feeding part 120, the ground part 130, and the plurality of components 400 may be electrically connected to the feeding pad 101, the ground pad 102, and the connection pads 103 through soldering through the respective connection parts 120S, 130S, and 400S.

The feeding pad 101, the ground pad 102, and the connection pads 103 may be formed through patterning of the upper surface of the printed circuit board 10, and may be made of a metal material, such as copper foil.

In addition, the connection parts 120S, 130S, and 400S may be formed, for example, in a ball grid array (BGA) type. However, the connection parts 120S, 130S, and 400S are not limited to the BGA type, but may be formed in various types in accordance with lead types of the ground part 130 and the components 400, for example, quad flat no lead (QFN), plastic leaded chip carrier (PLCC), quad flat package (QFP), small out line package (SOP), and thin/shrink/thin shrink SOP (TSOP/SSOP/TSSOP).

As described above, the antenna elements 100 and the plurality of components 400 may be mounted on the printed circuit board 10 through the connection parts 120S, 130S, and 400S, and the plurality of antenna elements 100 and the plurality of components 400 may be collectively mounted on the printed circuit board 10.

A method for collectively mounting the plurality of antenna elements 100 and the plurality of components 400 on the printed circuit board 10 will be described later.

The antenna element 100 composed of the radiation part 110, the feeding part 120, and the ground part 130 may be composed of a planar inverted F antenna (PIFA).

Further, the antenna element 100 may also be composed of an inverted F antenna (IFA) or a horn antenna. In addition, the antenna element 100 may be composed of various kinds of antennas.

Figure 4A:
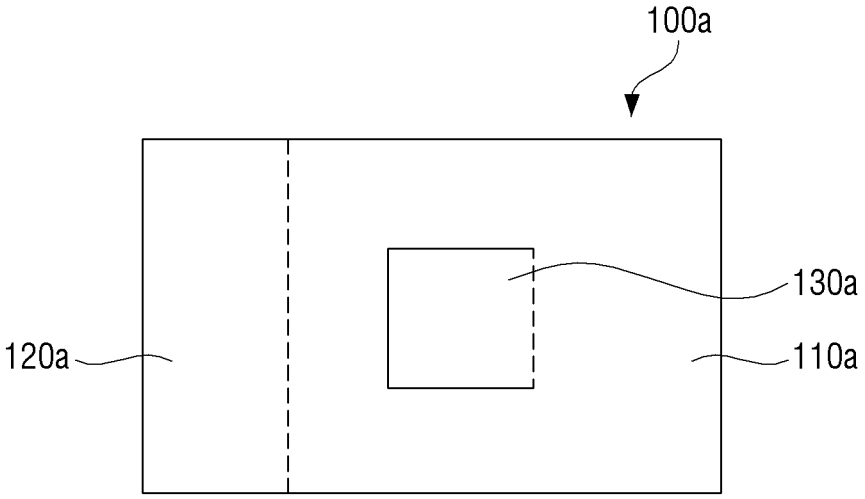
FIGS. 4A and 4B illustrate a metal sheet used to manufacture an antenna element illustrated in FIG. 2 and the antenna element according to an embodiment of the disclosure.
Figure 4B:
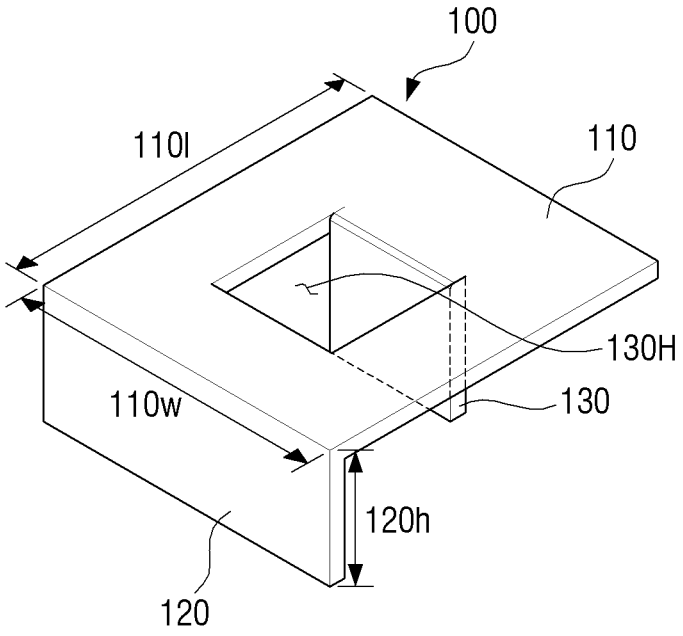

FIGS. 4A and 4B illustrate a metal sheet used to manufacture an antenna element illustrated in FIG. 2 and the antenna element according to an embodiment of the disclosure.

Referring to FIGS. 4A and 4B, the antenna element 100 composed of the radiation part 110, the feeding part 120, and the ground part 130 may be integrally formed through a press process or a mold process of a metal sheet 100*a*.

As illustrated in FIGS. 4A and 4B, the antenna element 100 may be manufactured through the press process or mold process of the rectangular metal sheet 100*a* made of a conductive metal.

Specifically, the radiation part 110 and the feeding part 120 of the antenna element 100 may be formed by partitioning the rectangular metal sheet 100*a* into a radiation portion 110*a* forming the radiation part 110 and a feeding portion 120*a* forming the feeding part 120 and by bending the feeding portion 120*a* from the radiation portion 110*a*.

In addition, the ground part 130 may be formed by cutting and bending one part 130*a* of the radiation portion 110*a* corresponding to the shape of the ground part 130. Accordingly, in the center of the radiation part 110, an opening 130H is formed through bending of the ground part 130.

The antenna element 100 may transmit/receive an electrical signal of a millimeter-wave frequency band, and thus may have an ultra-compact size in the unit of a millimeter.

For example, the width 110*w* of the radiation part 110 may be 2 mm, the length 1101 of the radiation part 110 may be 2.5 mm, and the height 120*h* of the feeding part 120 may be 1 mm. In addition, the thicknesses of the radiation part 110, the feeding part 120, and the ground part 130 constituting the antenna element 100 may be in the range of several tens to several hundreds of micrometers (μm).

As described above, in manufacturing the antenna element 100, the ultra-compact antenna element 100, in which the radiation part 110, the feeding part 120, and the ground part 130 are integrally formed through the press process or mold process of the single metal sheet 100*a*.

In addition, in a method similar to the method for manufacturing the antenna element 100, a plurality of antenna elements 100 may be collectively manufactured by press-processing a single metal sheet having a larger size than the size of the metal sheet 100*a* illustrated in FIG. 4A.

Referring again to FIGS. 2 and 3, the antenna part 1000 includes an insulating dam 200 formed on the printed circuit board 10 and configured to surround the at least one antenna element 100, and a dielectric part 300 configured to fill an inside of the insulating dam 200 and to support the at least one antenna element 100.

The insulating dam 200 may be formed along a predetermined area on the printed circuit board 10, and may be configured to surround the at least one antenna element 100 mounted on the printed circuit board 10.

Accordingly, the insulating dam 200 may be in the shape of a closed loop surrounding the plurality of antenna elements 100, and the height of the insulating dam 200 may correspond to the height of the antenna element 100. For example, the height of the insulating dam 200 may be equal to the height of the feeding part 120 and the ground part 130.

The insulating dam 200 may be molded by discharging an insulating material having a specific viscosity onto the printed circuit board 10, and may be formed by discharging the insulating material having the specific viscosity to surround the plurality of antenna elements 100. The insulating material may be a material having electric insulation.

Further, since the insulating dam 200 should be configured with a constant height on the printed circuit board 10, it is preferable that the insulating material for forming the insulating dam 200 has the viscosity enough to keep a constant height without running down while being discharged onto the printed circuit board 10.

For example, it is preferable that the insulating material for forming the insulating dam 200 has viscosity of 20,000 to 5,000,000 cps so that the discharged insulating material maintains a specific dam shape after being discharged.

The insulating material for forming the insulating dam 200 may be a thixotropy material having liquidity or a phase change (thermoplastic or thermosetting) material, or may be made of synthetic resin. Further, the insulating material for forming the insulating dam 200 may be room temperature curable after being discharged onto the printed circuit board 10 with a specific dam shape, and may be thermoset through heating at a constant temperature. It is preferable that the insulating material for forming the insulating dam 200 is a material that is cured in a short time after being discharged.

The dielectric part 300 may be made of a dielectric material discharged inside the insulating dam 200. The dielectric material for forming the dielectric part 300 may have electric insulation and a specific viscosity.

The dielectric material for forming the dielectric part 300 may be the same kind of material as the kind of the insulating material for forming the insulating dam 200 as described above, and may be a thixotropy material having liquidity or a phase change (thermoplastic or thermosetting) material. For example, the dielectric part 300 may be made of various dielectric materials, such as poly sterol having high dielectric constant, ferrite, or epoxy resin.

However, since the dielectric part 300 is formed by filling a dielectric material in a space surrounded by the insulating dam 200, it is preferable that the dielectric material for forming the dielectric part 300 has higher liquidity than the liquidity of the insulating material for forming the insulating dam 200. For example, it is preferable that the viscosity of the dielectric material for forming the dielectric part 300 is 100 to 30,000 cps.

The dielectric part 300 may also be formed by curing the dielectric material discharged inside the insulating dam 200.

The insulating dam 200 may prevent the dielectric material discharged inside the insulating dam 200 from overflowing to an outside of the insulating dam 200.

The dielectric part 300 made of the dielectric material charged inside the insulating dam 200 supports the antenna element 100 by surrounding the feeding part 120 and the ground part 130 of the antenna element 100.

As illustrated in FIG. 3, the radiation part 110 is deployed on the dielectric part 300 to radiate an electrical signal upward.

The dielectric part 300 may stably fix and support the antenna element 100 by surrounding the feeding part 120 and the ground part 130 of the antenna element 100.

Further, since the dielectric part 300 surrounds a part (feeding part 120) of the antenna element 100, the size of the antenna element 100 can be reduced. Specifically, the wavelength of the electrical signal (wave) passing through the dielectric part 300 is reduced in reverse proportion to the square root of the dielectric constant of the dielectric part 300, and through this, the overall size of the antenna element 100 surrounded by the dielectric part 300 may become more compact in a predetermined wavelength (frequency) range of the electrical signal.

Figure 5A:
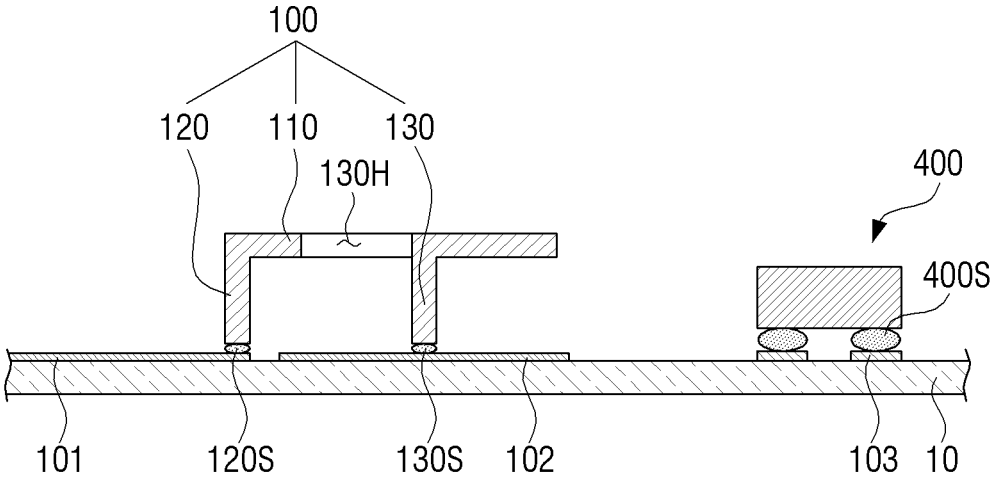
FIGS. 5A, 5B and 5C are cross-sectional views illustrating a process of manufacturing an antenna part illustrated in FIG. 3 according to an embodiment of the disclosure.
Figure 5B:
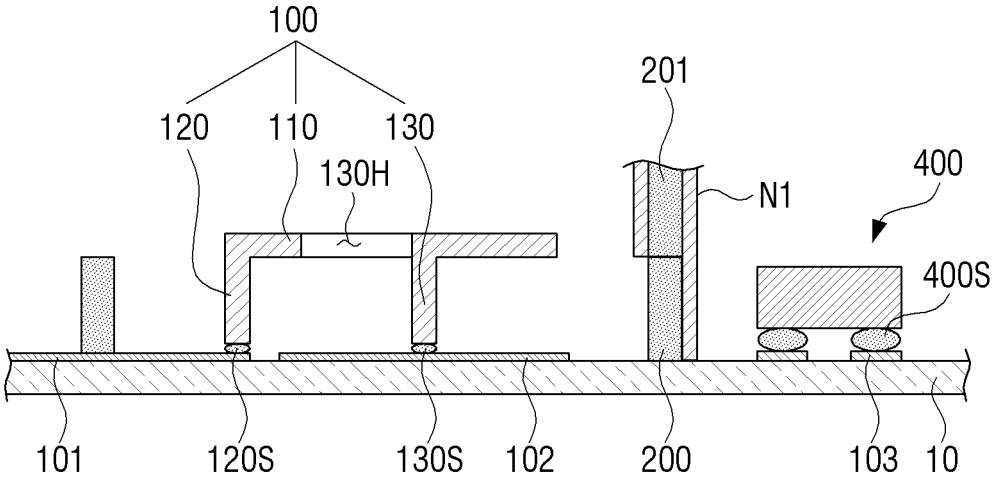
Figure 5C:
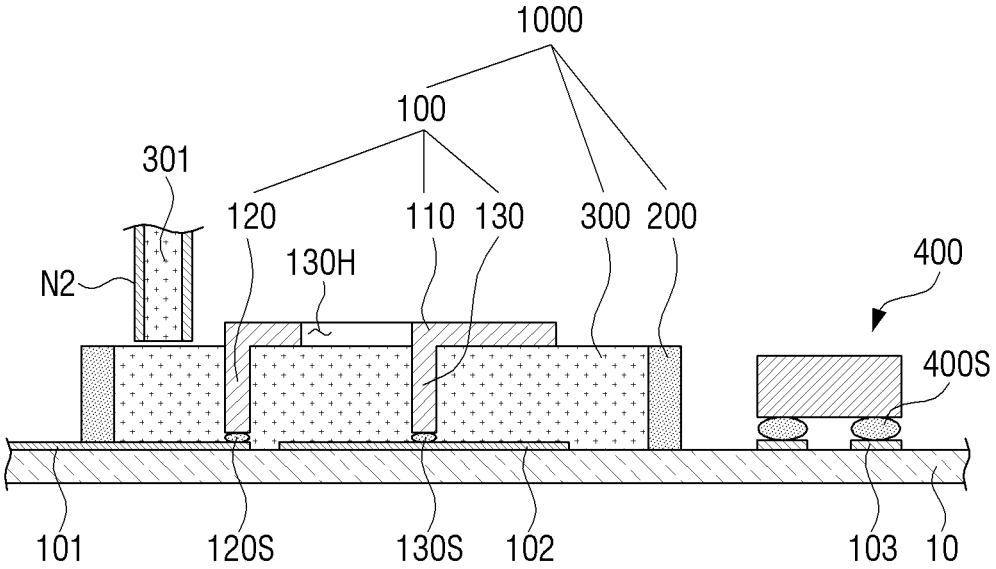

FIGS. 5A, 5B, and 5C are cross-sectional views illustrating a process of manufacturing an antenna part illustrated in FIG. 3 according to an embodiment of the disclosure.

Referring to FIGS. 5A, 5B, and 5C, a process of manufacturing an antenna part 1000 on a printed circuit board 10 according to an embodiment of the disclosure will be described.

First, as illustrated in FIG. 5A, a plurality of components 400 and at least one antennal element 100 are collectively mounted on the printed circuit board 10.

The at least one antenna element 100 may be a plurality of antenna elements 100, and the plurality of antenna elements 100 and the plurality of components 400 may be collectively mounted on the printed circuit board 10.

For example, the plurality of antenna elements 100 may be mounted on the printed circuit board 10 in a pick & place manner together with the plurality of components 400 in a process of assembling the components 400 on the printed circuit board 10.

As described above, the antenna element 100 may have a structure in which the radiation part 110, the feeding part 120, and the ground part 130 are integrally formed through the press process of the metal sheet 100*a*, and the feeding part 120 and the ground part 130 may be mounted on the printed circuit board 10 through soldering on the feeding pad 101 and the ground pad 102 through the connection parts 120S and 1305.

In addition, the plurality of components 400 may also be mounted on the printed circuit board 10 through soldering on the plurality of connection pads 103 through the plurality of connection parts 400S.

Accordingly, by collectively soldering the antenna elements 100 and the plurality of components 400 on the printed circuit board 10, the antenna elements 100 and the plurality of components 400 can be simultaneously mounted on the printed circuit board 10.

For example, the plurality of antenna elements 100 and the plurality of components 400 may be collectively mounted on the printed circuit board 10 through a collective reflow of the connection parts 120S, 130S, and 400S in a state where the plurality of antenna elements 100 and the plurality of components 400 are deployed in predetermined locations of the printed circuit board 10.

Specifically, the plurality of antenna elements 100 and the plurality of components 400 may be collectively mounted on the printed circuit board 10 by collectively melting the connection parts 120S, 130S, and 400S through a reflow process in a state where the respective feeding parts 120 of the plurality of antenna elements 100 are deployed on the feeding pad 101 through the corresponding connection part 120S, the respective ground parts 130 of the plurality of antenna elements 100 are deployed on the ground pad 102 through the corresponding connection part 130S, and the plurality of components 400 are deployed on the plurality of connection pads 103 through the corresponding connection parts 400S.

Thereafter, as illustrated in FIG. 5B, the insulating dam 200 surrounding the at least one antenna element 100 is formed by discharging through a first nozzle N1 an insulating material 201 having a specific viscosity onto the printed circuit board 10 on which the at least one antenna element 100 and the plurality of components 400 are mounted.

Specifically, the insulating dam 200 may be molded by discharging the insulating material 201 having the specific viscosity on the printed circuit board 10 through the first moving nozzle N1.

In this case, since the insulating material has high viscosity of 20,000 to 5,000,000 cps, the insulating material 201 discharged from the first nozzle N1 can maintain the specific dam shape. Further, the insulating dam 200 may be formed in the shape of a wall surrounding the plurality of antenna element 100.

The first nozzle N1 moves while discharging the insulating material 201 on the printed circuit board 10, and thus the insulating dam 200 in a closed loop shape can be formed.

In addition, the end portion of the first nozzle N1 discharging the insulating material 201 may correspond to the shape of the insulating dam 200. Specifically, of the end portion of the first nozzle N1, one part toward the antenna element 100 is opened, and another part opposite to the one part toward the antenna element 100 may be in a closed shape.

The first nozzle N1 may discharge the insulating material 201 as moving along a predetermined route corresponding to the shape of the insulating dam 200, and in such a moving process, the open part of the end portion of the first nozzle N1 may be rotated to maintain a state where it faces the antenna element 100.

The insulating dam 200 may be formed through a 3D printer (not illustrated) having the first nozzle N1.

The insulating material 201 discharged through the first nozzle N1 is cured at room temperature may maintain the shape of the insulating dam 200, and in addition, it may be cured through heating at a constant temperature.

Thereafter, as illustrated in FIG. 5C, the dielectric part 300 supporting at least one antenna element 100 is formed by discharging a dielectric material 301 having a specific viscosity inside the insulating dam 200 through a second nozzle N2.

As described above, it is preferable that the viscosity of the dielectric material 301 forming the dielectric part 300 is lower than the viscosity of the insulating material 201 forming the insulating dam 200.

Since the dielectric material 301 discharged inside the insulating dam 200 has liquidity, it may fill in an inner space of the insulating dam 200, and through this, it may be possible to surround the feeding part 120 and the ground part 130 of the antenna element 100 deployed inside the insulating dam 200 through the dielectric part 300. Accordingly, the structure of the antenna element 100 may be stably supported and fixed through the dielectric part 300.

In addition, it is preferable that the dielectric material 301 forming the dielectric part 300 is discharged as high as a height corresponding to the height of the feeding part 120 or the height of the ground part 130 so that the radiation part 110 is deployed on an upper side of the dielectric part 300. Through this, the upper surface of the radiation part 110 may not be covered by the dielectric part 300, but may be exposed to an outside.

The dielectric part 300 may also be formed through the 3D printer having the second nozzle N2. In addition, the 3D printer is provided with the first and second nozzles N1 and N2, and thus can successively form the insulating dam 200 and the dielectric part 300 through the first and second nozzles N1 and N2.

Since the dielectric material 301 discharged through the second nozzle N2 is cured at room temperature, the shape of the insulating dam 200 can be maintained, and in addition, the dielectric material 301 may be cured through heating at a constant temperature.

As described above, according to the electronic device 1 according to an embodiment of the disclosure, the assembling process of the antenna element 100 can be simplified by manufacturing the ultra-compact antenna element 100 in which the radiation part 110, the feeding part 120, and the ground part 130 are integrally formed through the press process of the metal sheet 100*a*, and by collectively mounting (packaging) the antenna elements 100 and the plurality of component 400 on the printed circuit board 10.

In addition, the ultra-compact antenna element 100 can be stably fixed and supported through the insulating dam 200 and the dielectric part 300, and the more compact antenna element 100 can be configured by surrounding a part of the antenna element 100 through the dielectric part 300.

Figure 6:
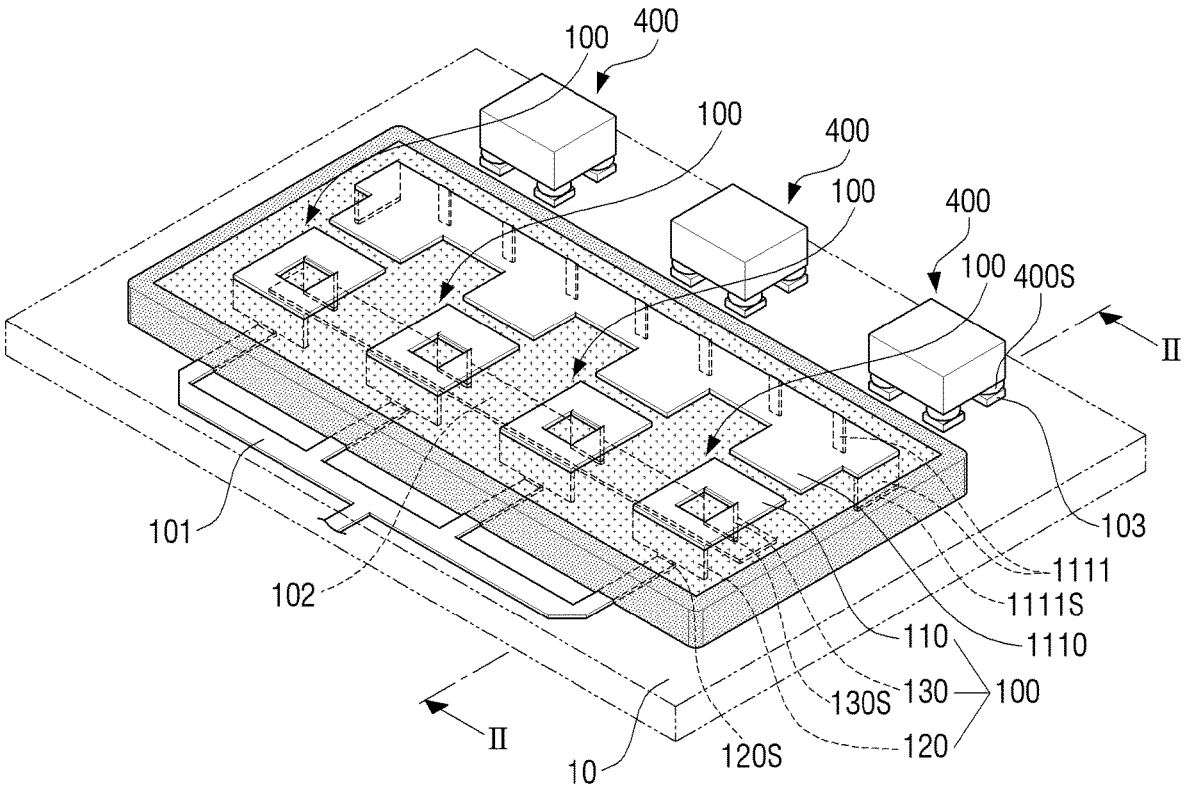
FIG. 6 is an enlarged perspective view of a part of a printed circuit board on which an antenna part and a dummy part are deployed according to an embodiment of the disclosure.
Figure 7:
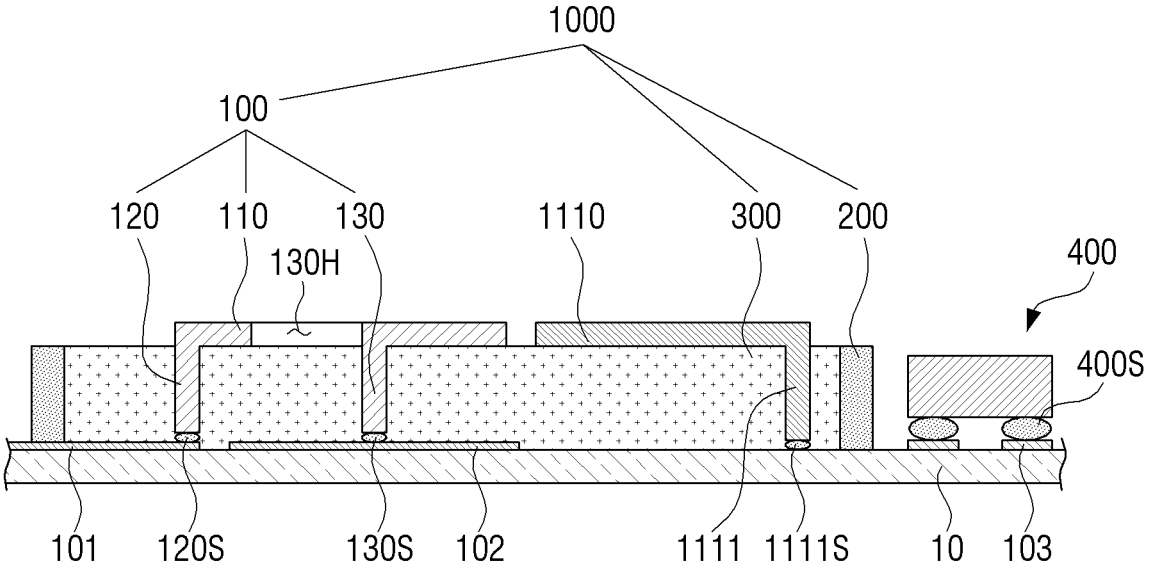
FIG. 7 is a cross-sectional view of a printed circuit board on which an antenna part and a dummy part are deployed taken along line II-II of FIG. 6 according to an embodiment of the disclosure.

FIG. 6 is an enlarged perspective view of a part of a printed circuit board on which an antenna part and a dummy part are deployed according to an embodiment of the disclosure, and FIG. 7 is a cross-sectional view of a printed circuit board on which an antenna part and a dummy part are deployed taken along line II-II of FIG. 6 according to an embodiment of the disclosure.

Referring to FIGS. 6 and 7, the antenna part 1000 according to an embodiment of the disclosure has the same configuration as the configuration of the antenna part 1000 according to an embodiment of the disclosure as illustrated in FIGS. 2 and 3, but is different from the antenna part 1000 according to an embodiment of the disclosure on the point that a dummy plate 1100 (see FIG. 8) including a dummy part 1110 is used in a process of combining a plurality of antenna elements 100.

Hereinafter, the structure of the antenna part 1000 and the dummy part 1110 according to an embodiment of the disclosure will be described around the different point from the antenna part 1000 illustrated in FIGS. 2 and 3.

As illustrated in FIGS. 6 and 7, a plurality of antenna elements 100 and a plurality of components 400 may be mounted on a printed circuit board 10, and four antenna elements 100 may be mounted.

Each of the plurality of antenna elements 100 includes a radiation part 110 configured to face a ground pad 102 of the printed circuit board 10, a feeding part 120 configured to be bent from the radiation part 110 and connected to a feeding pad 101 of the printed circuit board 10, and a ground part 130 configured to connect the radiation part 110 and the ground pad 102 with each other.

The antenna element 100 composed of the radiation part 110, the feeding part 120, and the ground part 130 may be integrally formed through a press process or a mold process of a metal sheet 100*a*.

Further, the antenna part 1000 includes an insulating dam 200 formed on the printed circuit board 10 and configured to surround the plurality of antenna elements 100 and a dielectric part 300 configured to fill an inside of the insulating dam 200 and to support the at least one antenna element 100.

The printed circuit board 10, the plurality of antenna elements 100, the insulating dam 200, the dielectric part 300, and the plurality of components 400 as illustrated in FIGS. 6 and 7 have the same structure as that of the printed circuit board 10, the plurality of antenna elements 100, the insulating dam 200, the dielectric part 300, and the plurality of components 400 as illustrated in FIGS. 2 and 3, and thus the duplicate explanation thereof will be omitted.

The dielectric part 300 may surround the respective feeding parts 120 and ground parts 130 of the plurality of antenna elements 100, and through this, the dielectric part 300 may stably fix and support the plurality of antenna elements 100.

In addition, on an inside of the insulating dam 200, a dummy part 1110 is deployed adjacent to the plurality of antenna elements 100.

The dummy part 1110 may be supported on the printed circuit board 10 through a plurality of support parts 1111, and the plurality of support parts 1111 may be combined with each other through soldering on the printed circuit board 10 through connection parts 1111S composed of solder balls or solder cream.

The dummy part 1110 may be stably fixed and supported since the plurality of support parts 1111 are surrounded by the dielectric part 300 in a state where the dummy part 1110 is supported on the printed circuit board 10 through the plurality of support parts 1111.

The upper surface of the dummy part 1110 may not be covered by the dielectric part 300, but may be exposed to an outside.

Figure 8:
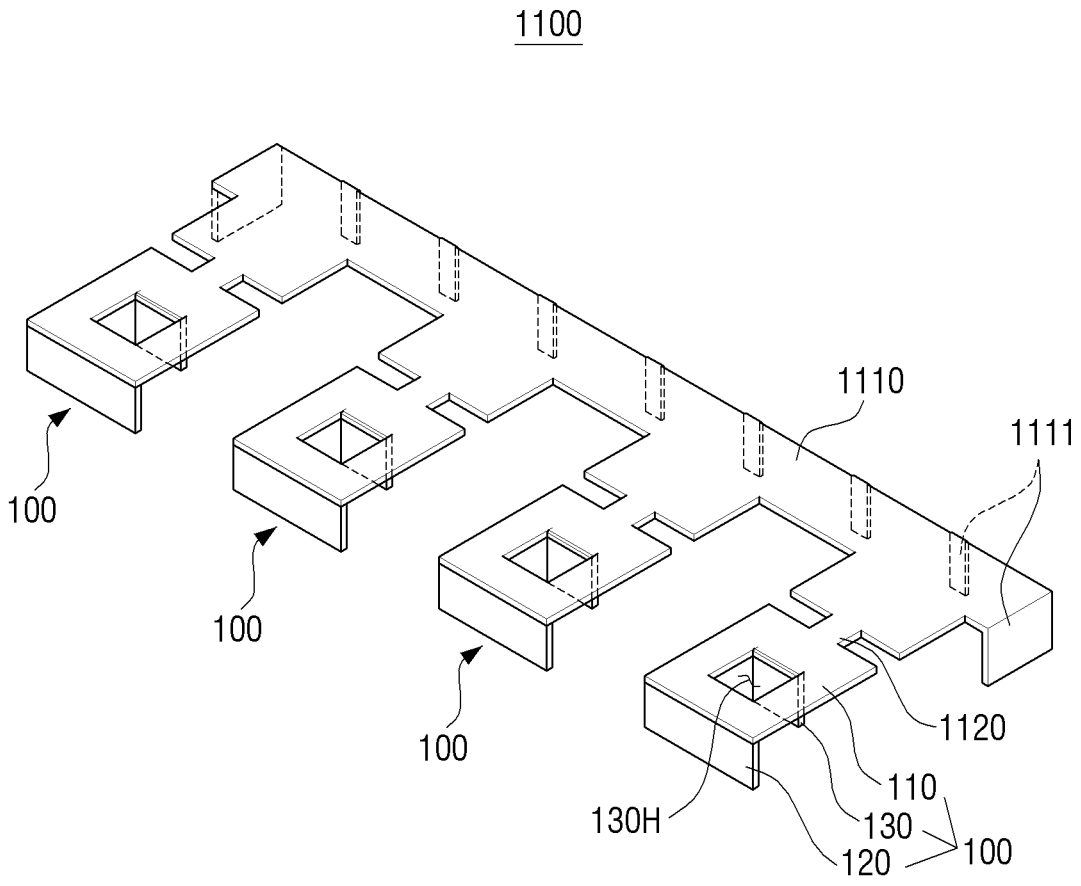
FIG. 8 is a perspective view of a dummy plate including a plurality of antenna elements and a dummy part illustrated in FIG. 6 according to an embodiment of the disclosure.

FIG. 8 is a perspective view of a dummy plate including a plurality of antenna elements and a dummy part illustrated in FIG. 6, and FIGS. 9A, 9B, 9C and 9D are cross-sectional views illustrating a process of manufacturing an antenna part illustrated in FIG. 7 according to an embodiment of the disclosure.

Figure 9A:
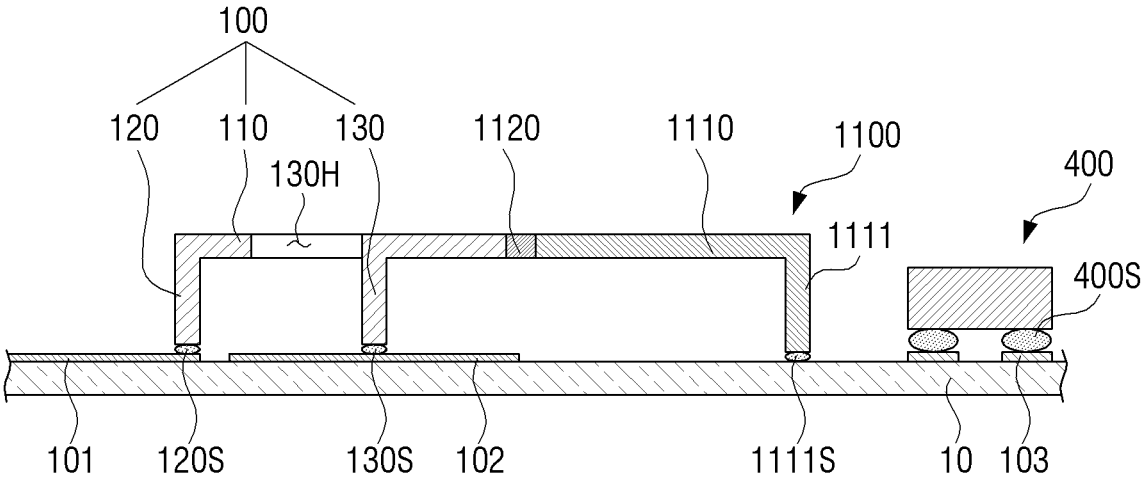
FIGS. 9A, 9B, 9C and 9D are cross-sectional views explaining a process of manufacturing an antenna part illustrated in FIG. 7 according to an embodiment of the disclosure.
Figure 9B:
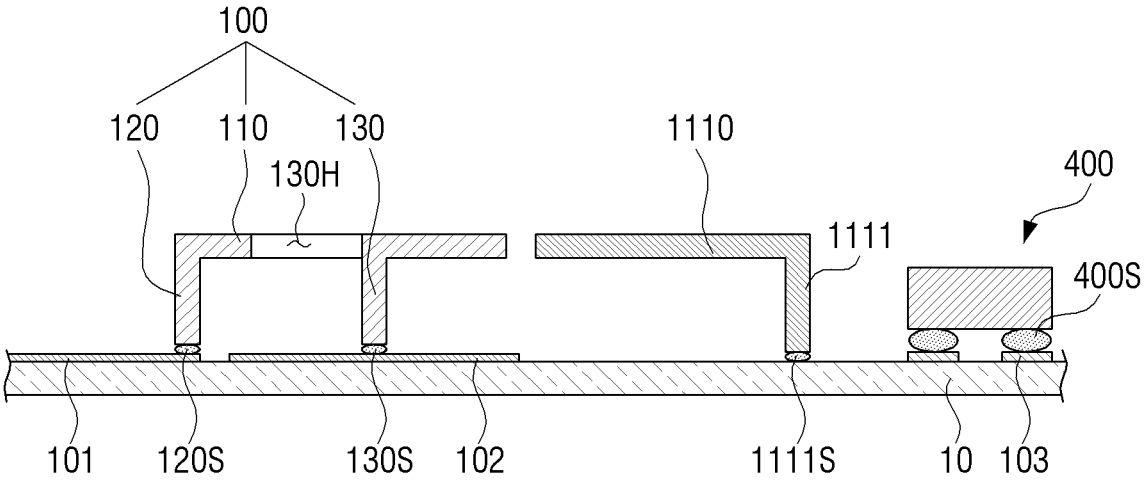
Figure 9C:
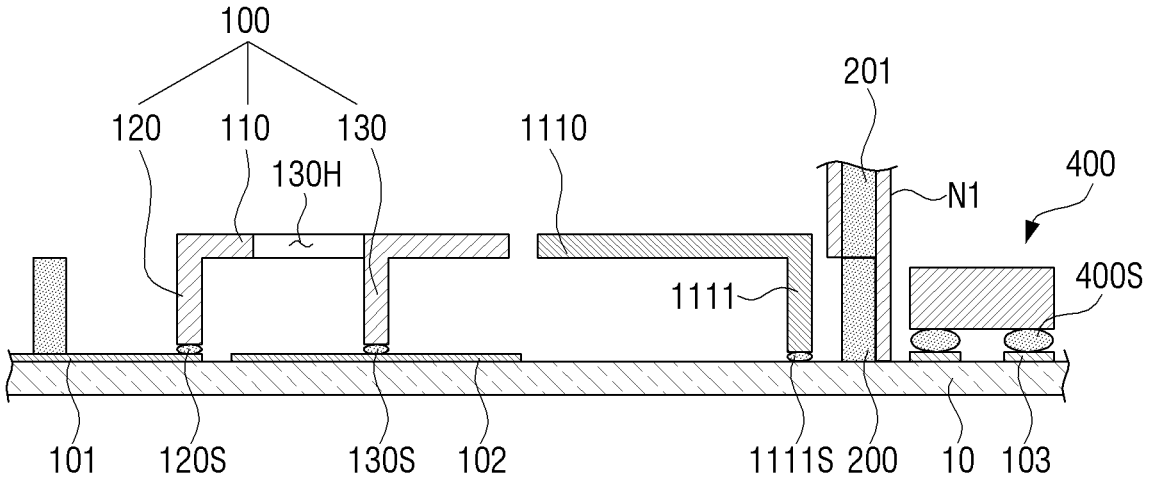
Figure 9D:
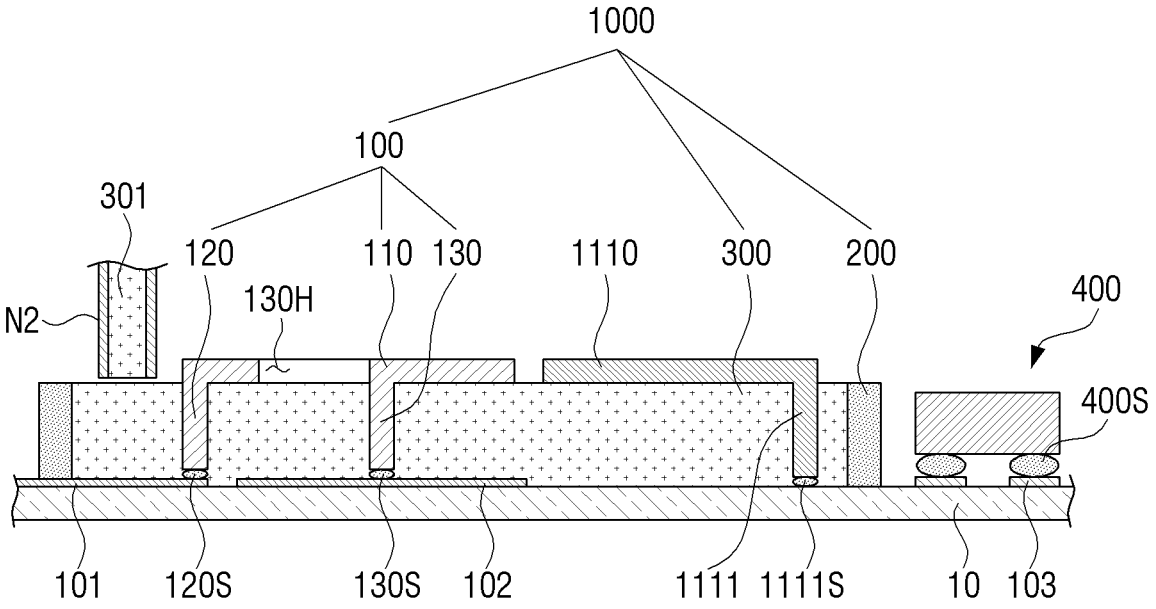

Referring to FIGS. 8 to 9D, a method for manufacturing an antenna part 1000 according to an embodiment of the disclosure.

First, as illustrated in FIGS. 8 to 9D, a dummy plate 1100 and a plurality of components 400 are collectively mounted on the printed circuit board 10.

Referring to FIG. 8, the dummy plate 1100 includes a plurality of antenna elements 100, a plurality of connection parts 1120 connected to the plurality of antenna elements 100, and a dummy part 1110 connected to the plurality of connection parts 1120.

Specifically, the dummy plate 1100 may be a metal plate on which the plurality of antenna elements 100, the plurality of connection parts 1120, and the dummy part 1110 are integrally formed, and may be configured by forming the metal plate made of a conductive metal in a predetermined shape.

As described above, the antenna elements 100 may be manufactured through the press process or the mold process of the metal sheet 100*a*, and the dummy plate 1100 including the plurality of antenna elements 100, the plurality of connection parts 1120, and the dummy part 1110 may also be manufactured through the press process or the mold process of a single metal sheet.

The plurality of connection parts 1120 connects respective radiation parts 110 of the plurality of antenna elements 100 and the dummy part 1110 with each other, and it is preferable that the width and the length thereof are configured to be smaller than the width and the length of the radiation part 110 so that the connection parts 1120 can be easily removed through a cutting process to be described later.

As illustrated in FIG. 9A, the dummy plate 1100 and the plurality of components 400 may be collectively mounted on the printed circuit board 10.

Each of the plurality of antenna elements 100 of the dummy plate 1100 may have a structure in which the radiation part 110, the feeding part 120, and the ground part 130 are integrally formed, and the feeding part 120 and the ground part 130 may be mounted on the printed circuit board 10 through soldering on the feeding pad 101 and the ground pad 102 through the connection parts 120S and 130S.

In addition, the dummy part 1110 may also be mounted on the printed circuit board 10 through soldering of the plurality of support parts 1111 on the printed circuit board 10 through the plurality of the connection parts 1111S.

Further, the plurality of components 400 may also be mounted on the printed circuit board 10 through soldering on the plurality of connection pads 103 through the plurality of connection parts 400S.

Specifically, the plurality of antenna elements 100 of the dummy plate 1100, the dummy part 1110, and the plurality of components 400 may be collectively mounted on the printed circuit board 10 through a collective reflow of the connection parts 120S, 130S, 400S, and 1111S in a state where the dummy plate 1100 and the plurality of components 400 are deployed in predetermined locations of the printed circuit board 10. However, the dummy part 1110 may be placed on the printed circuit board 10 without separate soldering through the connection part 1111S, and may be removed through cutting of the connection part 1120 to be described later.

As described above, by mounting a single dummy plate 1100 on the printed circuit board 10, the plurality of antenna elements 100 can be collectively mounted on the printed circuit board 10, and in addition, by collectively mounting the dummy plate 1100 and the plurality of components 400 on the printed circuit board 10, the plurality of antenna elements 100 and the plurality of components 400 can be collectively mounted on the printed circuit board 10 only in a single process.

Thereafter, as illustrated in FIG. 9B, the plurality of antenna elements 100 are separated from the dummy part 1110 by cutting the plurality of connection parts 1120 of the dummy plate 1100.

The plurality of connection parts 1120 may be removed through laser cutting, and through this, the plurality of antenna elements 100 are respectively separated from the dummy part 1110 to be separated from each other.

Thereafter, as illustrated in FIG. 9C, the insulating dam 200 surrounding the plurality of antenna elements 100 is formed by discharging through a first nozzle N1 an insulating material 201 having a specific viscosity onto the printed circuit board 10 on which the plurality of antenna elements 100 and the plurality of components 400 are mounted.

As illustrated in FIG. 9C, the insulating dam 200 may be molded in the shape surrounding the dummy part 1110, and in addition, may be molded in the shape surrounding only the plurality of antenna elements 100 without surrounding the dummy part 1110.

Thereafter, as illustrated in FIG. 9D, the dielectric part 300 supporting at least one antenna element 100 is formed by discharging a dielectric material 301 having a specific viscosity inside the insulating dam 200 through a second nozzle N2.

The dielectric part 300 may surround the feeding part 120 and the ground part 130 of the antenna element 100 deployed inside the insulating dam 200. In addition, the dielectric part 300 may surround the plurality of support parts 1111 of the dummy part 1110.

Through this, the dielectric part 300 may stably fix and support the plurality of antenna elements 100 and the dummy part 1110.

However, the cutting of the plurality of connection parts 1120 as described above may be performed after the dielectric part 300 is formed.

As described above, according to the antenna part 1000 according to an embodiment of the disclosure, a process of combining the plurality of antenna elements 100 on the printed circuit board 10 can be simplified by collectively mounting the plurality of antenna elements 100 on the printed circuit board 10 through the dummy plate 1100, and through this, the manufacturing process and manufacturing time and cost of the electronic device 1 to which the plurality of antenna elements 100 are applied can be reduced.

In addition, since the dummy plate 1100 can be easily manufactured in a desired shape through the press process or mold process of a single metal sheet, the plurality of antenna elements 100 can be manufactured through a simple process.

Figure 10:
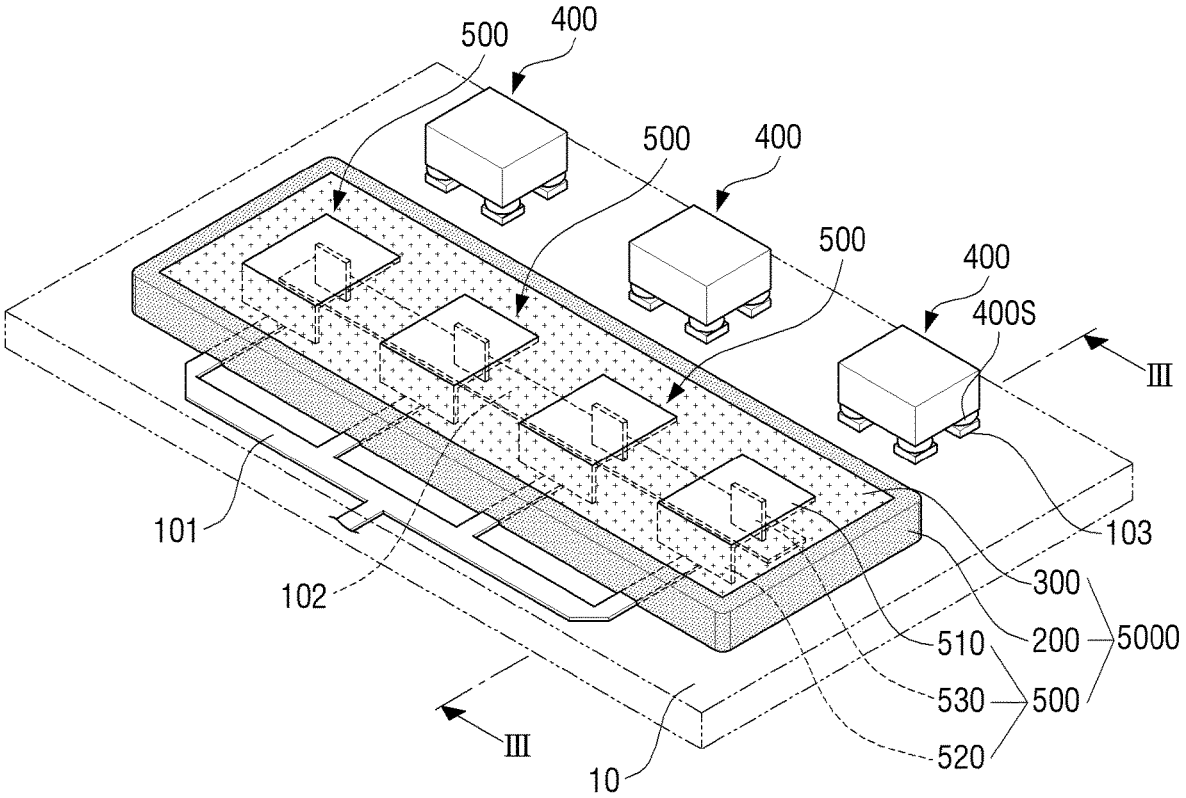
FIG. 10 is an enlarged perspective view of a part of a printed circuit board on which an antenna part is deployed according to an embodiment of the disclosure.
Figure 11:
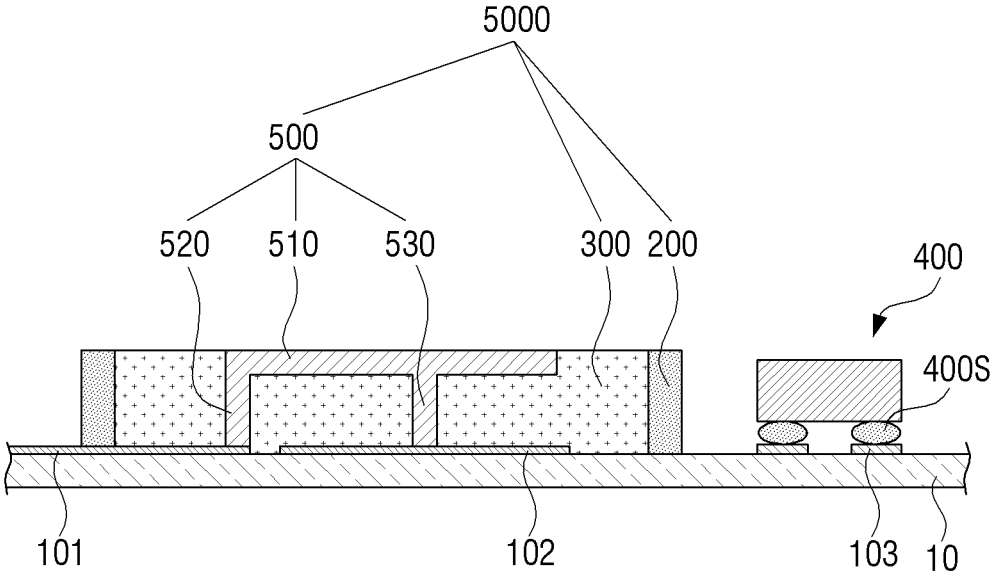
FIG. 11 is a cross-sectional view of a printed circuit board on which an antenna part is deployed taken along line of FIG. 10 according to an embodiment of the disclosure.

FIG. 10 is an enlarged perspective view of a part of a printed circuit board on which an antenna part is deployed according to an embodiment of the disclosure, and FIG. 11 is a cross-sectional view of a printed circuit board on which an antenna part is deployed taken along line of FIG. 10 according to an embodiment of the disclosure.

Referring to FIGS. 10 and 11, an antenna part 5000 according to an embodiment of the disclosure has a similar structure to the structure of the antenna part 1000 according to an embodiment of the disclosure as illustrated in FIGS. 2 and 3, but is different from the antenna part 1000 according to an embodiment of the disclosure on the point that antenna elements 500 are made of a conductive material discharged onto the dielectric part 300.

Hereinafter, the structure of the antenna part 5000 according to an embodiment of the disclosure will be described around the different point from the antenna part 1000 illustrated in FIGS. 2 and 3.

As illustrated in FIGS. 10 and 11, a plurality of components 400 and an antenna part 5000 are deployed on the printed circuit board 10.

The antenna part 5000 includes at least one antenna element 500, an insulating dam 200, and a dielectric part 300.

The insulating dam 200 may be in a closed loop shape surrounding the plurality of antenna elements 100, and is formed in the shape of a specific dam.

The dielectric part 300 made of a dielectric material is formed inside the insulating dam 200.

The plurality of antenna elements 500 are deployed inside the dielectric part 300.

Each of the plurality of antenna elements 500 includes a radiation part 510 configured to face a ground pad 102, a feeding part 520 configured to be bent from the radiation part 510 and connected to a feeding pad 101, and a ground part 530 configured to connect the radiation part 510 and the ground pad 102 with each other.

The radiation part 510 may radiate an electrical signal since power is fed thereto through the feeding part 520, and the feeding part 520 may also radiate an electrical signal since power is fed thereto from the feeding pad 101.

As illustrated in FIGS. 10 and 11, the antenna element 500 may be composed of a planar inverse F antenna (PIFA).

The antenna element 500 has a similar structure to the structure of the antenna element 100 as illustrated in FIGS. 2 and 3, but is different from the antenna element 100 pre-molded through the metal sheet 100*a* on the point that a conductive material fills in a radiation groove 510H of the dielectric part 300, a feeding hole 520H, and a ground hole 530H.

FIGS. 12A, 12B, 12C and 12D are cross-sectional views illustrating a process of manufacturing an antenna part as illustrated in FIG. 11 according to an embodiment of the disclosure.

Referring to FIGS. 12A, 12B, 12C and 12D, a method for manufacturing an antenna part 5000 according to an embodiment of the disclosure will be described.

Figure 12A:
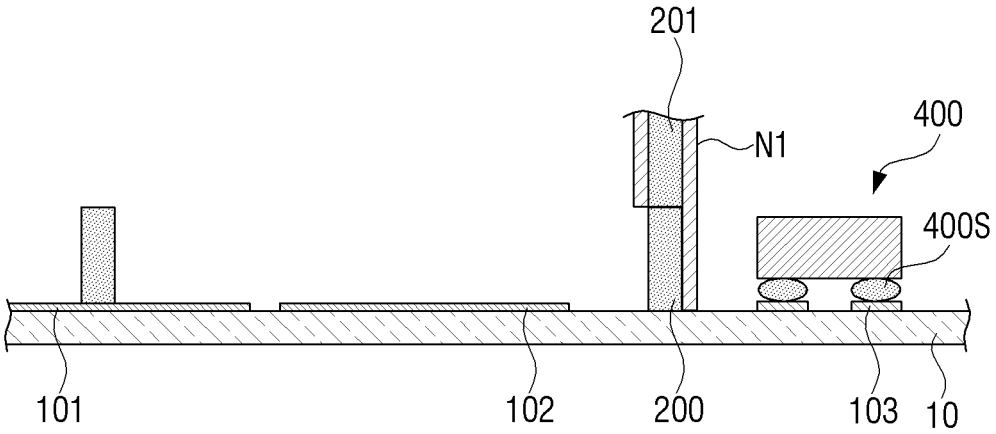
FIGS. 12A, 12B, 12C and 12D are cross-sectional views explaining a process of manufacturing an antenna part illustrated in FIG. 11 according to an embodiment of the disclosure.

First, as illustrated in FIG. 12A, an insulating dam 200 surrounding a feeding pad 101 and a ground pad 102 of a printed circuit board 10 is formed by discharging through a first nozzle N1 an insulating material 201 having a specific viscosity onto the printed circuit board 10.

Specifically, the dam-shaped insulating dam 200 forming a closed loop may be molded by discharging the insulating material 201 having the specific viscosity onto the printed circuit board 10 through the first moving nozzle N1.

Inside the insulating dam 200, a part of the feeding pad 101 and the ground pad 102 may be deployed.

Figure 12B:
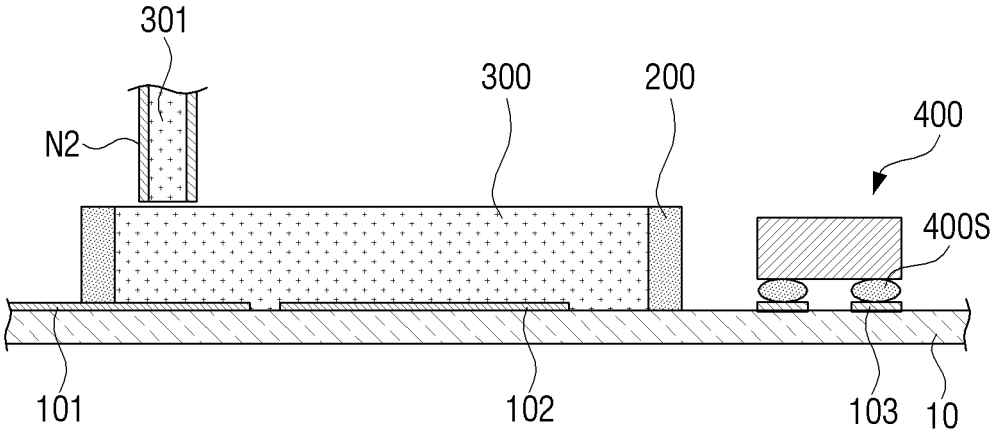

Thereafter, as illustrated in FIG. 12B, a dielectric part 300 is formed by discharging a dielectric material 301 having a specific viscosity inside the insulating dam 200 through a second nozzle N2.

The dielectric material 301 discharged to an inside of the insulating dam 200 has liquidity and may fill in an inner space of the insulating dam 200.

Figure 12C:
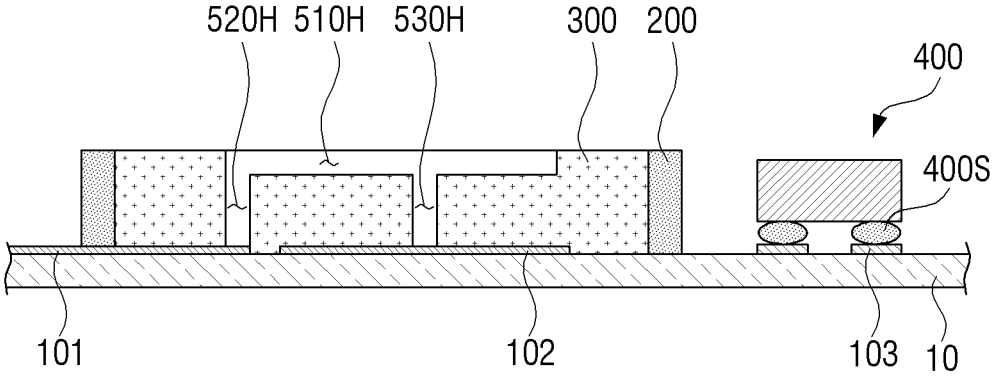

Thereafter, as illustrated in FIG. 12C, at least one feeding hole 520H connected from one surface (upper surface) of the dielectric part 300 to the feeding pad 101 of the printed circuit board 10 through penetration of the dielectric part 300, and at least one ground hole 530H connected from the one surface of the dielectric part 300 to the ground pad 102 of the printed circuit board 10 through penetration of the dielectric part 300 are formed.

In addition, at least one radiation groove 510H connecting the at least one feeding hole 520H and the at least one ground hole 530H with each other is formed on one surface of the dielectric part 300.

The radiation groove 510H, the feeding hole 520H, and the ground hole 530H are formed to have shapes corresponding to a predetermined shape of the antenna element 100, and the radiation groove 510H, the feeding hole 520H, and the ground hole 530H are formed to have shapes corresponding to the predetermined shapes of the radiation part 510, the feeding part 520, and the ground part 530.

The radiation groove 510H, the feeding hole 520H, and the ground hole 530H may be formed through laser cutting, and a plurality of radiation grooves 510H, a plurality of feeding holes 520H, and a plurality of ground holes 530H may be collectively formed.

Figure 12D:
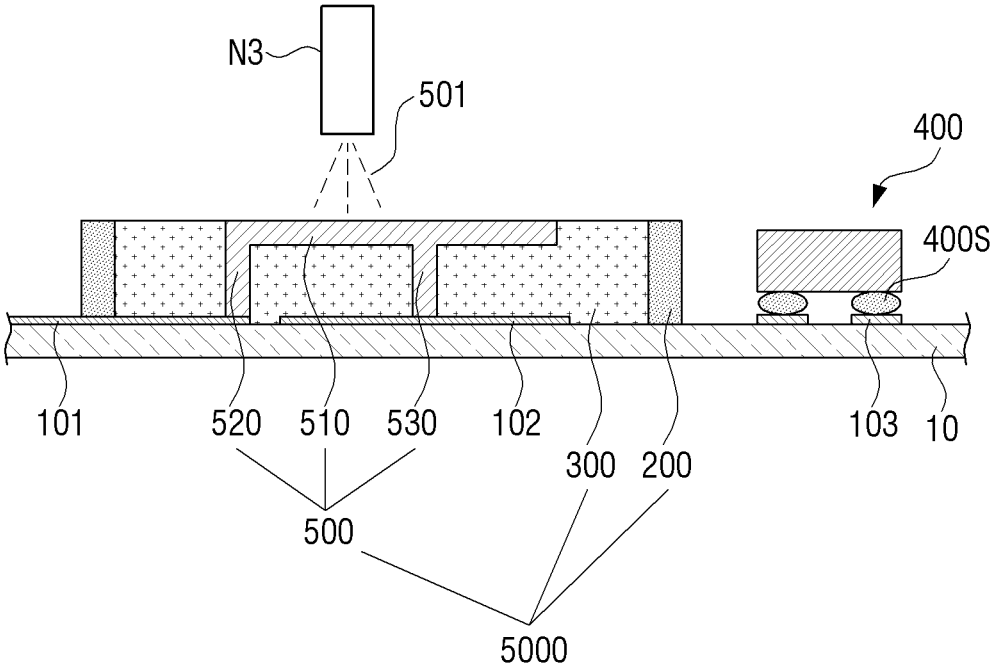

Thereafter, as illustrated in FIG. 12D, the antenna element 500 is formed by discharging a conductive material 501 onto the feeding hole 520H, the ground hole 530H, and the radiation groove 510H through a third nozzle N3.

The conductive material 501 may be made of, for example, an electrically conductive filler or electrically conductive ink.

By filling the conductive material 301 discharged through the third nozzle N3 in the feeding hole 520H, the ground hole 530H, and the radiation groove 510H, the antenna element 500 in which the radiation part 510, the feeding part 520, and the ground part 530 are integrally formed may be formed.

Through this, the feeding part 520 may be connected to the feeding pad 101, the ground part 530 may be connected to the ground pad 102, and the radiation part 510 may be connected to the feeding part 520 and the ground part 530.

The antenna element 500 that transmits/receives an electrical signal of a millimeter-wave frequency band may be configured with a thin thickness in the range of several tens to several hundreds of micrometers (μm), and it is preferable that the diameters of the feeding hole 520H and the ground hole 530H and the height of the radiation groove 510H are configured in the range of several tens to several hundreds of μm.

The conductive material 301 for forming the antenna element 301 may be jetted through the third nozzle N3.

In addition, a 3D printer may have first to third nozzles N1, N2, and N3, and by successively discharging the insulating material 201, the dielectric material 301, and the conductive material 501 through the first to third nozzles N1, N2, and N3, the insulating dam 200, the dielectric part 300, and the antenna element 500 can be formed.

As described above, according to the antenna part 5000 according to an embodiment of the disclosure, the antenna elements 500 can be formed without any separate antenna element assembling process by forming the insulating dam 200 and the dielectric part 300 on the printed circuit board 10, forming the radiation groove 510H, the feeding hole 520H, and the ground hole 530H through cutting of the dielectric part 300, and filling the conductive material in the radiation groove 510H, the feeding hole 520H, and the ground hole 530H. Through this, the manufacturing process and manufacturing time and cost of the electronic device 1 to which the plurality of antenna elements 500 are applied can be reduced.

From the foregoing, although various embodiments of the disclosure have been individually described, the respective embodiments are not required to be individually implemented, but the configurations and operations of the respective embodiments may be implemented in combination with at least one other embodiment.

The foregoing embodiments and advantages are merely various and are not to be construed as limiting the disclosure. The present teaching can be readily applied to other types of apparatuses. In addition, the description of the embodiments of the disclosure is intended to be illustrative, and not to limit the scope of the claims, and many alternatives, modifications, and variations will be apparent to those skilled in the art.

Certain aspects of the present disclosure can also be embodied as computer readable code on a non-transitory computer readable recording medium. A non-transitory computer readable recording medium is any data storage device that can store data which can be thereafter read by a computer system. Examples of the non-transitory computer readable recording medium include a Read-Only Memory (ROM), a Random-Access Memory (RAM), Compact Disc-ROMs (CD-ROMs), magnetic tapes, floppy disks, and optical data storage devices. The non-transitory computer readable recording medium can also be distributed over network coupled computer systems so that the computer readable code is stored and executed in a distributed fashion. In addition, functional programs, code, and code segments for accomplishing the present disclosure can be easily construed by programmers skilled in the art to which the present disclosure pertains.

At this point it should be noted that the various embodiments of the present disclosure as described above typically involve the processing of input data and the generation of output data to some extent. This input data processing and output data generation may be implemented in hardware or software in combination with hardware. For example, specific electronic components may be employed in a mobile device or similar or related circuitry for implementing the functions associated with the various embodiments of the present disclosure as described above. Alternatively, one or more processors operating in accordance with stored instructions may implement the functions associated with the various embodiments of the present disclosure as described above. If such is the case, it is within the scope of the present disclosure that such instructions may be stored on one or more non-transitory processor readable mediums. Examples of the processor readable mediums include a ROM, a RAM, CD-ROMs, magnetic tapes, floppy disks, and optical data storage devices. The processor readable mediums can also be distributed over network coupled computer systems so that the instructions are stored and executed in a distributed fashion. In addition, functional computer programs, instructions, and instruction segments for accomplishing the present disclosure can be easily construed by programmers skilled in the art to which the present disclosure pertains.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. An electronic device comprising:

a printed circuit board on which a plurality of components are mounted;

at least one antenna element mounted on the printed circuit board;

an insulating dam formed on the printed circuit board and configured to surround the at least one antenna element; and a dielectric part configured to fill an inside of the insulating dam and to support the at least one antenna element.

2. The electronic device of claim 1, wherein the printed circuit board comprises a feeding pad to which the at least one antenna element is connected and a ground pad to which the at least one antenna element is connected.

3. The electronic device of claim 2, wherein the at least one antenna element comprises:

a radiation part configured to face the ground pad;

a feeding part configured to be bent from the radiation part and connected to the feeding pad; and a ground part configured to connect the radiation part and the ground pad with each other.

4. The electronic device of claim 3, wherein the dielectric part surrounds the feeding part and the ground part, and wherein the radiation part is deployed on the dielectric part.

5. The electronic device of claim 4, wherein the radiation part, the feeding part, and the ground part are integrally formed through a press process of a metal sheet.

6. The electronic device of claim 4, wherein the dielectric part comprises:

at least one feeding hole connected from one surface of the dielectric part to the feeding pad through penetration of the dielectric part;

at least one ground hole connected from the one surface of the dielectric part to the ground pad through penetration of the dielectric part; and at least one radiation groove formed on the one surface of the dielectric part and configured to connect the at least one feeding hole and the at least one ground hole with each other, wherein the radiation part, the feeding part, and the ground part are composed of a conductive material filling in the radiation groove, the feeding hole, and the ground hole, respectively.

7. The electronic device of claim 3, wherein the radiation part is further configured to radiate an electrical signal vertically relative to the printed circuit board, and wherein the feeding part is further configured to radiate an electrical signal horizontally relative to the printed circuit board.

8. The electronic device of claim 1, wherein a plurality of antenna elements are configured to constitute an array antenna.

9. The electronic device of claim 1, wherein the plurality of components and the at least one antenna element are collectively mounted on the printed circuit board.

10. The electronic device of claim 1, wherein the insulating dam is configured in a shape of a closed loop that surrounds the at least one antenna element.

11. The electronic device of claim 1, wherein a height of the insulating dam corresponds to a height of the at least one antenna element.

12. A method for manufacturing an electronic device, the method comprising:

collectively mounting a plurality of components and a plurality of antenna elements on a printed circuit board;

forming an insulating dam surrounding the plurality of antenna elements by discharging an insulating material having a specific viscosity onto the printed circuit board; and forming a dielectric part supporting the plurality of antenna elements by discharging a dielectric material having a specific viscosity to an inside of the insulating dam.

13. The method of claim 12, wherein the printed circuit board includes:

a feeding pad to which the plurality of antenna elements are connected, and a ground pad to which the a plurality of antenna elements are connected, and wherein each of the plurality of antenna elements includes:

a radiation part configured to face the ground pad, a feeding part configured to be bent from the radiation part and connected to the feeding pad, and a ground part configured to connect the radiation part and the ground pad with each other.

14. The method of claim 13, wherein the forming of the dielectric part discharges the dielectric material with a height corresponding to a height of the feeding part or a height of the ground part.

15. The method of claim 13, wherein the radiation part, the feeding part, and the ground part are integrally formed through a press process of a metal sheet.

16. The method of claim 13, wherein the radiation part is further configured to radiate an electrical signal vertically relative to the printed circuit board, and wherein the feeding part is further configured to radiate an electrical signal horizontally relative to the printed circuit board.

17. The method of claim 12, wherein the mounting of the plurality of antenna elements on the printed circuit board comprises:

collectively mounting on the printed circuit board the plurality of components and a dummy plate including the plurality of antenna elements, a plurality of connection parts connected to the plurality of antenna elements, and a dummy part connected to the plurality of connection parts; and separating the plurality of antenna elements from the dummy part by cutting the plurality of connection parts.

18. At least one non-transitory computer readable storage medium for storing a computer program of instructions configured to be readable by at least one processor for instructing the at least one processor to execute a computer process for performing functions of method of claim 12.

19. A method for manufacturing an electronic device, the method comprising:

forming an insulating dam surrounding a feeding pad and a ground pad of a printed circuit board by discharging an insulating material having a specific viscosity onto the printed circuit board;

forming a dielectric part by discharging a dielectric material having a specific viscosity to an inside of the insulating dam;

forming at least one feeding hole connected from one surface of the dielectric part to the feeding pad of the printed circuit board through penetration of the dielectric part and at least one ground hole connected from the one surface of the dielectric part to the ground pad of the printed circuit board through penetration of the dielectric part;

forming at least one radiation groove connecting the at least one feeding hole and the at least one ground hole with each other on the one surface of the dielectric part; and forming at least one antenna element by discharging a conductive material into the at least one feeding hole, the at least one ground hole, and the at least one radiation groove.

20. The method of claim 19, wherein the forming of the dielectric part discharges the dielectric material with a height corresponding to a height of the feeding part or a height of the ground part.

* * * * *